US010513318B1

(12) United States Patent
Parks et al.

(10) Patent No.: US 10,513,318 B1
(45) Date of Patent: Dec. 24, 2019

(54) STABILIZING WATER DIFFUSER SYSTEM FOR WATER SPORTS BOARD, WATER SPORTS BOARD WITH WATER DIFFUSER SYSTEM, AND METHOD OF USING THE SAME

(71) Applicant: Mink Surf LLC, Waianae, HI (US)

(72) Inventors: John Parks, Waianae, HI (US); Edric Taira, Honolulu, HI (US); Doug Silva, Honolulu, HI (US)

(73) Assignee: Mink Surf LLC, Waianae, HI (US)

( * ) Notice: Subject to any disclaimer, the term of this patent is extended or adjusted under 35 U.S.C. 154(b) by 0 days.

(21) Appl. No.: 16/285,034

(22) Filed: Feb. 25, 2019

(51) Int. Cl.
*B63B 35/79* (2006.01)

(52) U.S. Cl.
CPC ..... *B63B 35/7923* (2013.01); *B63B 35/793* (2013.01); *B63B 35/7926* (2013.01)

(58) Field of Classification Search
CPC ..... B63B 35/73; B63B 35/79; B63B 35/7926; B63B 35/793; B63B 3/00; B63B 3/38
USPC ..... 441/79
See application file for complete search history.

(56) References Cited

U.S. PATENT DOCUMENTS

| | | | | |
|---|---|---|---|---|
| 4,325,154 | A | 4/1982 | Collum, Jr. | |
| 5,106,331 | A | 4/1992 | Lizarazu | |
| 5,273,472 | A | 12/1993 | Skedeleski et al. | |
| 5,480,331 | A | 1/1996 | Lewis | |
| 5,487,351 | A * | 1/1996 | Nedderman, Jr. | B63B 39/06 441/79 |
| 6,551,157 | B1 * | 4/2003 | Bishop | B63B 35/7926 441/79 |
| 6,585,549 | B1 | 7/2003 | Fryar | |
| 6,718,897 | B1 | 4/2004 | De Bello | |
| 6,896,570 | B1 | 5/2005 | O'Keefe et al. | |
| 6,935,908 | B2 * | 8/2005 | Garcia | B63H 11/01 440/71 |
| 7,524,225 | B1 | 4/2009 | Richenberg et al. | |
| 8,246,406 | B2 | 8/2012 | Field | |
| 9,505,471 | B2 | 11/2016 | Wunner | |
| 9,957,020 | B2 | 5/2018 | Mead | |
| 10,023,275 | B2 | 7/2018 | Carroll | |
| 10,106,230 | B2 | 10/2018 | Richenberg | |
| 2004/0072483 | A1 | 4/2004 | Panzer | |

(Continued)

FOREIGN PATENT DOCUMENTS

| | | |
|---|---|---|
| DE | 3334653 | 4/1985 |
| DE | 19913185 | 9/2000 |

(Continued)

OTHER PUBLICATIONS

"Bonzer 5," Accessed on Nov. 15, 2018, https://www.jyebyrnessurfboards.com.au/bonzer5.

*Primary Examiner* — Lars A Olson
(74) *Attorney, Agent, or Firm* — Dentons US LLP

(57) ABSTRACT

A water diffuser system and a water sports board with a water diffuser system installed thereon, wherein the water diffuser system can improve stability of a water sports board by modulating the cavitation and turbulence caused by the fin system of the water sports board. The water diffuser system includes one or more water diffusers. The one or more water diffusers can be located at the tail edge of the bottom surface of the water sports board. The water diffusers can have rigid hydrofoil structures that are able to modulate the turbulent flow and cavitation caused by known fin systems.

21 Claims, 18 Drawing Sheets

(56) References Cited

U.S. PATENT DOCUMENTS

| | | | | |
|---|---|---|---|---|
| 2008/0287018 | A1 | 11/2008 | Johnson | |
| 2009/0258553 | A1 | 10/2009 | Leek | |
| 2016/0144933 | A1 * | 5/2016 | Kumano | B63B 35/7926 441/79 |
| 2017/0001695 | A1 | 1/2017 | Lowry | |

FOREIGN PATENT DOCUMENTS

| | | |
|---|---|---|
| FR | 2516472 | 5/1983 |
| GB | 2008516 | 6/1979 |
| WO | 2013159860 | 10/2013 |

* cited by examiner

STABILIZING WATER DIFFUSER SYSTEM FOR WATER SPORTS BOARD, WATER SPORTS BOARD WITH WATER DIFFUSER SYSTEM, AND METHOD OF USING THE SAME

BACKGROUND OF THE INVENTION

Field of the Invention

The present invention relates to a system and method to improve stability of a water sport board. Particularly, the present invention is directed to a water diffuser system having one or more water diffusers and a water sports board having such water diffuser system with one or more water diffusers installed thereon.

Discussion of the Related Art

Water sport board activities have become a ubiquitous means of entertainment and athletics. A common piece of equipment that is used across the various activities is the water sport board, the overall design of which can vary depending on the particular use. Exemplary types of water sport boards include surfboards, paddle boards, kiteboards, wakeboards, wakesurf boards, and windsurfing boards. There are also multiple designs with different sizes and shapes for each type of water sport board. For example, surfboards designs include longboards, funboards, shortboards, and large wave boards also known as guns. Likewise the size and shape of paddle boards can be varied depending on the type of performance that is desired. Each type of board can also include particular design variations such as different nose and tail designs, amount of rocker in each board, the design of the rails, and the fin system used with each board.

The design of a water sports board varies depending on the type of water sports board it is. A generic top-down view diagram of an exemplary water sports boards is illustrated in FIG. 8. The broken lines illustrate overlapping outlines of different water sports boards, longboard 810, gun 820, funboard 830, shortboard 840, kiteboard 850. Wakesurf boards are similar to surfboards and thus are not illustrated separately. A paddle board and a windsurfing board can each have the general outline similar to any of a shortboard, a funboard, and a longboard, and thus they are not illustrated separately. Also, wakeboards have designs similar to that of a kiteboard and thus it is also not separately illustrated.

A water sports board typically includes a rigid body with two ends. The rigid body can be made of glass covered foam, wood, composite, laminate or any other known suitable material for water sports boards.

The rigid body includes a center axis 801 along its length where the center axis is equidistant from the edges or rails. The end of the water sports board that is typically kept in front when in use is generally referred to as the nose. This is identified as item 812, 822, 832, 842, and 852. The end of the water sports board that is typically kept in the back during use is generally referred to as the tail. This is identified as item 811, 821, 831, 841, and 851. An exception to the nose and tail references 851 and 852 can be present for kiteboards since a kiteboard can also be designed to be ridden in both directions and thus these ends can be referred as either or both. This is further described in more detail in the description.

A generic diagram of an exemplary water sports board design is also illustrated in FIGS. 9A-9B. The diagrams of side view FIG. 9A and top perspective view FIG. 9B illustrate a water sports board 900 that includes a rigid body 905 with a bottom surface 906 and a deck or top surface 907. The board 900 can include sides or rails 908, nose 901, and tail 902. On the bottom surface 906 is one or more fin systems 903 each including one or more fins 904. During typical use, a surfer would be located on deck 907 while the bottom surface 906 glides over water. The diagram of FIGS. 9A-9B is only illustrative and exemplary.

Most design variations for each water sport board reflect a particular performance feature that is often associated with the particular intended use for that water sports board. For example, the overall shape including the volume, shape of the nose, tail, and rails, the overall size, the type and number of fins and the fin systems used all can be modified. For purposes of this disclosure, "volume" or "board volume" of a water sports board refers to the amount of space the water sports board occupies. The volume or board volume of a water sports board is equal to the volume of a liquid displaced when the water sports board is submerged in that liquid. Also, additional features can be present such as, for example, padding as typically used in surfboards, wakesurf boards and paddle boards. Also, particular types of water sports boards, such as kiteboards and wakeboards, can include foot straps on the deck of the board.

Common across the various designs, however, has remained the interest to achieve improved stability and overall performance. Some exemplary attempts to achieve these characteristics include the implementation of different tail designs as for example described in in U.S. Patent Publication No. 2008/0287018, which is incorporated herein by reference. Exemplary tail designs that are well known include unpointed designs such as the Pintail, Thumbtail, and Squash, pointed tail designs such as the Swallow, Bat Tail, Diamond, and Square tails.

Another approach to improve stability and performance has been in the area of fin systems used in various boards, for example as described in U.S. Pat. No. 9,957,020 and WO2013/159860, which are both incorporated herein by reference. Another approach has been to create channels on the bottom of the water sports board either by carving concave portions on the bottom of the board or by implementing a fin system that forms channels as for example described in U.S. Pat. No. 6,585,549, which is incorporated herein by reference.

Although prior art designs have provided much improvement in the stability, maneuverability, and overall performance of various water sport boards, there is still a need to improve stability.

Accordingly, a need still exists for an implemented design that can further promote stability and improve performance of a water sport board by addressing the above identified turbulence and cavitation problems.

SUMMARY OF THE INVENTION

Accordingly, the present invention is directed to a stabilizing water diffuser system for water sports board, water sports board with water diffuser system, and method of using the same that substantially obviates one or more of the problems due to limitations and disadvantages of the related art.

An advantage of the present invention is to reduce turbulence and cavitation in a water sport board, particularly with respect to the turbulence and cavitation caused by a typical fin system.

Another advantage of the present invention is to provide a water sports board with increased stability.

Another advantage of the present invention is to provide a water sports board that can exhibit improved speed performance.

Another advantage of the present invention is to promote smother water flow off the tail of a water sport board, thus resulting in a smoother ride.

Another advantage of the present invention is to help provide more lift especially at lower speeds and more stability at higher speeds.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, provided is a water diffuser for a water sports board having a base, a vertical member, and a front edge. The base can have a front end and back end. The vertical member can extend from the base to a distal end. The front edge can extend from the front end of the base to the distal end of the vertical member. The front edge can include a first slope between the front end and the vertical member and a second slope along the vertical member, wherein the second slope is steeper than the first slope so as to define a concave contour.

The base further can further include a sidewall extending from a perimeter of the base to the vertical member. The sidewall can have an overall concave contour. The front end of the base can have a width that is smaller than the width of the back end of the base. The base can include a teardrop shape. The base can include a shape selected from a triangular shape, a rectangular shape, a polygonal shape, a regular elliptical shape, or an irregular elliptical shape. Opposite the vertical member the base can include an underside surface. The underside surface can be coated with an adhesive. The adhesive can have a thickness of about 0.03 inches.

The base can have a longitudinal length extending from the pointed end to a round end that ranges from about 0.7 inches to about 3.0 inches.

The vertical member can include an elongated elliptical cross-section defined by a first sidewall and a second sidewall. The vertical member can have a width from about 0.06 inches to about 0.4 inches. The combined height of the base and vertical member can range from about 0.1 inches to about 2.0 inches.

The base and vertical member each can include a rigid material. The rigid material can be selected from the group consisting of polymer plastic, carbon fiber, fiberglass, epoxy, metal, foam, and combinations thereof. The base and the vertical member can include the same rigid material.

The vertical member can have a truncated profile at the distal end. The vertical member can include a flat surface at the distal end. The vertical member can have a truncated profile and include a flat surface at the distal end. The flat surface can have a teardrop shape. The flat surface can have an elliptical shape.

The water diffuser can also include one or more screw holes, one or more lip portions, or a combination of both.

In another aspect of the present invention, provided is a water sports board having a rigid body having a tail edge, a fin system located on a bottom surface of the rigid body, and a water diffuser located on the bottom surface of the rigid body between the fin system and the tail edge, wherein the water diffuser is positioned to reduce cavitation caused by the fin system.

The water sports board can be one selected from the group consisting of a shortboard, a longboard, a funboard, a windsurfing board, a paddle board, a wakeboard, a wakesurf board, and a kiteboard.

The water diffuser can be located at a distance from the tail edge that ranges from about 0.06 inches to about 4 inches.

The water sports board can include one or more additional water diffusers located on the bottom surface of a tail of a water sports board. The water sports board can include a total of two or more water diffusers. The water sports board can include a total of four or more water diffusers. At least two or more diffusers can be arranged to be toe-in with respect to a central axis of the water sports board.

The fin system can be selected from the group consisting of a single fin system, a two fin system, a three fin system, a four fin system, and a five fin system.

A water diffuser can have a longitudinal length ranging from about 0.7 inches to about 3 inches. A water diffuser can have a height ranging from about 0.1 inches to about 2 inches.

The water sports board can include a total of two or more water diffusers equally laterally spaced from each other. The water sports board can include a total of two or more water diffusers equally spaced from the tail edge. The distance between the tail edge and each of the two or more water diffusers can range from about 0.06 inches to about 4 inches.

A water diffuser can be permanently attached to the water sports board. A water diffuser can be detachably attached to the water sports board. A water diffuser can be attached to the bottom surface of the water sports board with adhesive, tape, one or more screws, one or more snap-joints, or a combination thereof. The adhesive can include an epoxy resin. The water sports board can include a frame attached to the water sports board, wherein the water diffuser is attached to frame or are an integral part of the frame.

A water diffuser can be an integral part of the water sports board. The water sports board can include glassing, wherein the water diffuser is located under the glassing. The water sports board can include glassing, wherein the water diffuser is part of the glassing.

A water diffuser can include a front edge that faces away from the tail edge, the front edge defining an overall concave contour.

In another aspect of the present invention, a method of stabilizing a water sports board including installing a water diffuser system to a bottom surface of a water sports board at a location between a fin system and a tail edge of the water sports board such that the water diffuser system is able to modulate the cavitation and turbulence caused by the fin system.

Installing a water diffuser system can include attaching one or more water diffusers to the bottom surface of the water sports board or attaching a frame comprising two or more water diffusers to the bottom surface of the water sports board. Each of the one or more water diffusers can have a longitudinal length in the range of about 0.7 inches to about 3 inches and a height in the range of about 0.1 inches to about 2 inches.

The method can include attaching the one or more water diffusers at a location that is no more than about 0.06 inches to about 4 inches from a tail edge of the water sports board.

The method can include attaching all of the one or more water diffusers to be equally spaced from the tail edge of the water sports board.

The method can include attaching the one or more water diffusers or the frame to the bottom surface of the water sports board with an adhesive.

The method can include attaching the one or more water diffusers or the frame to the bottom surface of the water sports board using a means selected from the group consisting of adhesive, tape, one or more screws, one or more snap-joints, and a combination thereof.

Each of the one or more water diffusers can include a rigid material. Each of the one or more water diffusers can include a base with a teardrop shape and a vertical member with a hydrofoil design.

Modulating the cavitation and turbulence can include contacting turbulent water flow with the one or more water diffusers to slice air bubbles and induce laminar flow.

The water diffuser system can also provide lift.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1A:
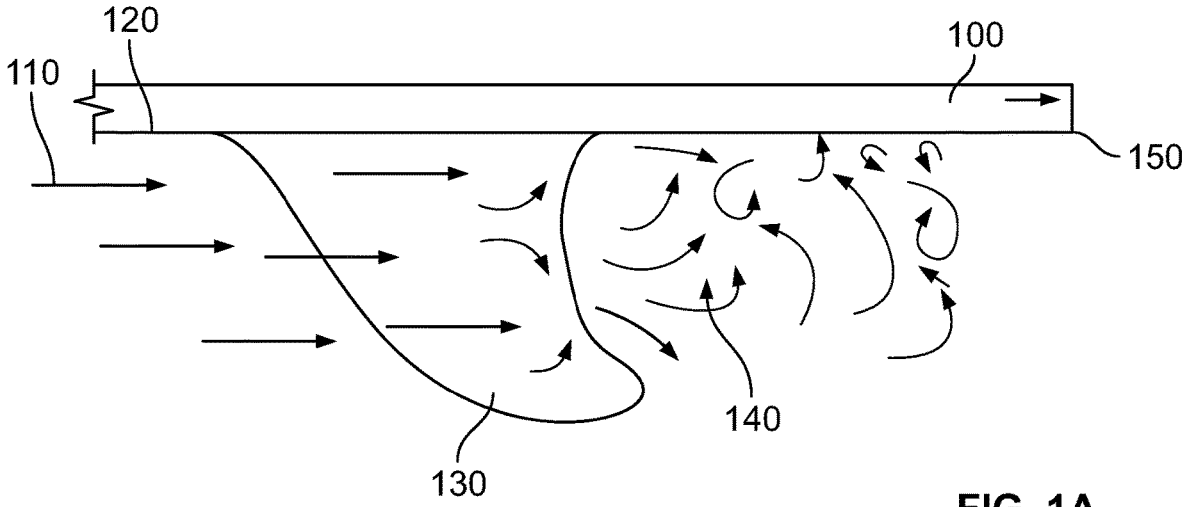
FIGS. 1A-1B are diagrams illustrating the turbulence and cavitation caused by a typical fin system used at the bottom surface of water sports boards.

Reference will now be made in detail to an embodiment of the present invention, example of which is illustrated in the accompanying drawings.

Unless defined otherwise, all technical and scientific terms used herein have the same meaning as is commonly understood by one of skill in the art to which the inventions belong. All patents, patent applications, published applications and publications, websites and other published materials referred to throughout the entire disclosure herein, unless noted otherwise, are incorporated by reference in their entirety. In the event that there are a plurality of definitions for terms herein, those in this section prevail. Where reference is made to a URL or other such identifier or address, it is understood that such identifiers can change and particular information on the internet can come and go, but equivalent information can be found by searching the internet. Reference thereto evidences the availability and public dissemination of such information.

As used herein, the singular forms "a," "an" and "the" include plural referents unless the context clearly dictates otherwise.

As used herein, the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

As used herein, ranges and quantities can be expressed as "about" a particular value or range. "About" also includes the exact amount. Hence "about 5 percent" means "about 5 percent" and also "5 percent." "About" means within typical experimental error for the application or purpose intended.

As used herein, "optional" or "optionally" means that the subsequently described event or circumstance does or does not occur, and that the description includes instances where the event or circumstance occurs and instances where it does not. For example, an optional component in a system means that the component may be present or may not be present in the system.

As used herein, a "combination" refers to any association between two items or among more than two items. The association can be spatial or refer to the use of the two or more items for a common purpose.

The term "water sports board" or "board" is broadly used herein to the full extent of its meaning to one of ordinary skill in the art and refers broadly to any right and planar watercrafts typically used for surface aquatic activities. Non limiting examples of water sports boards include all types of surfboards, windsurfing boards, paddle boards, wakeboards, kiteboards, and wakesurf boards.

The term "bottom" or "bottom surface" when used to describe a portion of a water sports board broadly refers to the surface of the water sports board that faces the water during typical use and not the surface where the user typically lies, kneels, or stands over the deck during typical use of the water sports board.

The term "deck" or "top surface" when used to describe a portion of a water sports board broadly refers to the surface of the water sports board over which a user typically lies, kneels, or stands during typical use of the water sports board.

The term "fin" is used herein to reference a hydrofoil affixed to the bottom surface of a water sports board to provide stability and maneuverability of the water sports board. Fins as referenced herein broadly refer to dolphin dorsal fin-like structures with a convex front edge of varying degree of rake or sweep. Fins as used herein include structures that must be sufficiently sized to maintain grip on the water so as to function as intended. Typically, fins as referenced herein have a length of at least 4 inches and a height greater than 2 inches, and typically greater than at least 4 inch.

The term "fin system" as used herein broadly refers to a typical fin arrangement in a particular water sports board. A fin arrangement can include one or more fins. Non-limiting examples of fin systems broadly known in the art that fall within the scope of the term "fin system" as used in this description include single fins systems, two-fin set ups known as Twin-fin, three-fin set ups some known as Thrusters and others as 2+1, four-fin set up known as Quad, or even a five-fin set up. In water sports boards such as shortboards, longboards, funboards, guns, paddle boards, and wakesurf boards, fin systems are typically located at the bottom surface that is under the deck area where the surfer's foot presses down while the surfer is standing and riding a wave.

The term "glass" or "glassing" as used herein broadly refers to the protective fiberglass and resin coating applied over a material, such as foam, of a water sports board. "Glassing material" as used herein to broadly refer to the materials used for glassing, which can include one or more of fiberglass cloth, polyester and epoxy resin, or a combination thereof.

The term "board blank" as used herein broadly refers to the original block of foam used to shape a surfboard, paddle board, windsurfing board, or wakesurf board. A blank often comes from a pre-shaped mold with a basic outline and rocker depending on the length and type of the board being shaped. A board blank is often made from polyurethane foam.

The term "nose" is used herein to broadly refer to the front portion of a water sports board. Particularly, the term "nose" as used herein refers to the front quarter length of a water sports board and the leading edge as used in the water.

The term "rail" as used herein is used to broadly reference the edge of a water sports board where the deck wraps around to meet the bottom surface; usually used to describe the lower half of the edge.

The term "tail" as used herein refers to the back portion of a water sports board. Particularly, it relates to the area extending between the fin system and the back edge of a water sports board.

The term "edge" is used herein to refer to the narrow part adjacent to a border where an object or area begins or ends.

The term "surfboard" as used herein broadly refers to any buoyant board used as a longboard, funboard, shortboard, or gun.

The term "shortboard" as used herein broadly refers to a smaller, performance surfboard typically in the 5 to 7 foot length range, nose to tail, designed for maximum speed through turns.

The term "gun" as used herein broadly refers to a special surfboard designed to ride big waves. They are typically narrow in the nose and tail to allow the rails full contact with the wave. Broadly longer than normal surfboards so the surfer can paddle faster to catch the bigger, faster moving waves, with a pulled-in tail to handle the high speeds. Typical length, nose to tail, of a gun surfboard ranges from about 6 foot 6 inches to about 10 foot.

The term "longboard" as used herein broadly refers to a surfboard distinctly longer and broader at the nose and tail than a conventional shortboard; usually over eight feet in length, nose to tail, and 22" or more in width, with a rounded nose.

The term "funboard" as used herein broadly refers to a compromise surfboard design, combining the superior paddling attributes of a longboard, but stripped of some of the length, nose to tail, and bulk of a longboard so that a rider may experience improved maneuverability.

The term "paddle board" as used herein broadly refers to a board used for stand up paddle surfing and stand up paddle boarding (SUP). A stand up paddle boarder stands on the board and uses a paddle to propel forward through the water. A stand up paddle board, or paddle board, can have different shapes but typically has a higher board volume than a shortboard so as to exhibit sufficient buoyancy to float when a user stands on it even while not riding a wave.

The term "kiteboard" as used herein broadly refers to a board similar to a wakeboard or a small surfboard, with or without footstraps or bindings. A kiteboard broadly is a small composite, wooden, or foam board. There are now several types of kiteboards: directional surf-style boards, wakeboard-style boards, hybrids which can go in either direction but are built to operate better in one of them, and skim-type boards. These boards broadly come with sandal-type footstraps that allow the rider to attach and detach from the board easily; this is required for doing board-off tricks and jumps. Kiteboards come in different shapes and sizes to suit the rider's skill level, riding style, wind and water conditions.

The term "wakeboard" as used herein broadly refers to a short board with or without foot bindings on which a rider is towed by a motorized watercraft such as a motorboat across its wake and especially up off the crest for aerial maneuvers.

The term "wakesurf board" as used herein broadly refers to a short board that is similar to a surfboard. The typical length of a wakesurf board is 4-5 feet. Similar to a wakeboard, a wakesurf board is used surf the wake of a motorized watercraft such as a motorboat. However, in wakesurfing the surfer is only towed at the start but then freely surfs the wake without the use of a tow rope.

The term "windsurfing board" as used herein broadly refers to a board propelled by wind pushing on a sail extending over the deck of the board. Windsurfing board include a fin systems. Broadly, windsurfing boards have lengths, nose to tail, ranging from about 6 feet and 7 inches to about 8 feet and 2 inches, and have a water displacements typically between 12 and 40 US gallons.

The term "water diffuser system" as used herein refers to the set of one or more water diffusers as described herein. Exemplary embodiments that fall within the scope of the present invention include water diffuser systems having one water diffuser, two water diffusers, three water diffusers, four water diffusers, five water diffusers, six water diffusers, seven water diffusers, eight water diffusers, nine water diffusers, ten water diffusers, or more. The number of water diffusers used in accordance with the present invention should not be viewed as limited and can be adjusted based on the size of the tail of the water sports board. It should be recognized, however, that water diffusers can add drag and thus adding a disproportionate amount of water diffusers can negatively affect performance. Also, the term "water diffuser system" should not be construed to be limited to a particular arrangement of water diffusers.

The term "water diffuser" as used herein refers to a structure as described in more detailed herein that broadly includes a hydrofoil designed to modulate the cavitation and/or turbulence caused by the fins of the fin system. The water diffuser is smaller in size than any of the fins of a fin system present on the same water sports board.

Figure 1B:
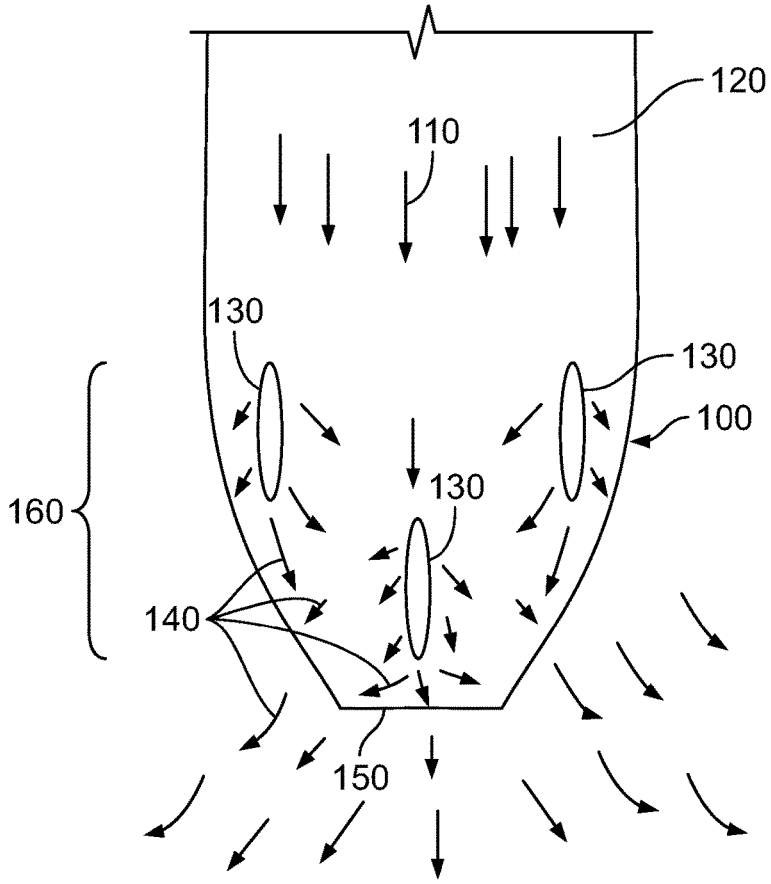

As a water sport board glides on the water, it experiences a lot of turbulence and cavitation that is often caused by the very fin system that is implemented to promote the performance of the water sports board. As illustrated in FIGS. 1A and 1B, as water 110 flows along the bottom surface 120 of a water sport board 100, it comes in contact with one of more fins 130 of the fin system 160. As a result of the water 110 contacting the fins 130 of the fin system 160, the water flow 110 becomes turbulent flow 140 creating a lot of air bubbles, thus giving rise to cavitation. For illustration purposes the turbulent flow with air bubbles are illustrated in FIG. 1A as curving arrows and in FIG. 1B as oblique arrows. This turbulence and cavitation occur unevenly, close to the bottom surface 120 of the water sport board 100 behind the fins 130 and at the tail edge 150 of the board 100. This negatively affects performance of the board because it causes instability, lowers maneuverability, and produces added drag.

Because the turbulence and cavitation is caused by the fins and fin-systems themselves, and since known fins system are generally located at a distance from the tail edge of a water sports board since their placement is generally desired under the area where a surfers back foot presses down, known fin systems are not capable of modulating this turbulent flow and cavitation at the tail edge of a water sports board.

To resolve this problem and provide improved stability and overall performance of a water sports board, the inventors have developed a water diffuser system that includes one or more water diffusers to be located near the tail edge of the bottom surface of a water sports board, and water sports boards having a water diffuser system with one or more water diffusers installed thereon. In embodiments, when installed on a water sports board at the described locations, i.e. at the bottom surface of the water sports board close to the tail edge of the water sports board between the fin system and the tail edge of the water sports board, the water diffuser system comprised of one or more water diffusers can reduce the cavitation effect by slicing through the bubbles present in the turbulent flow at the tail of the water sports board. The water diffuser system comprised of one or more water diffusers can also provide additional lift at lower speeds as well as improved stability at higher speeds, thereby improving overall performance of the water sports board. Accordingly, the invention also includes improved water sports boards with a water diffuser system comprised of one or more water diffusers installed thereon.

FIGS. 2A-2E illustrate exemplary embodiments of a water diffuser 200 in accordance with the present invention. The water diffuser 200 includes a base 210 and a vertical member 220. Water diffuser 200 can be made as a rigid structure to better withstand the high water pressure during use. The base 210 and vertical member 220 can both be part of a rigid structure. Base 210 and vertical member 220 can form a sturdy structure so as to be able to withstand the high water pressure impacting it during use. Base 210 and vertical member 220 can each be made of a rigid material. Exemplary suitable rigid materials for a water diffuser, including base 210 and vertical member 220, include polymer plastic, carbon fiber, fiberglass, epoxy, metal, foam, Kevlar, ABS plastic, PLA, polyamide (nylon), glass filled polyamide, stereolithography materials (epoxy resins), resin, silver, titanium, steel, wax, photopolymers, polycarbonate, and any combination thereof.

Any suitable manufacturing method of making the water diffuser can be used. For example, the water diffuser 200 can be casted, 3D printed, sculpted, thermoformed, vacuum formed, or injection molded.

The water diffuser 200 can be manufactured as a single integral structure having base 210 and vertical member 220. Alternatively, water diffuser 200 can be manufactured in parts that when assembled together form water diffuser 200. For example, base 210 and vertical member 220 can be manufactured separately and then joined as discussed below.

Although described separately herein, it should be understood that base 210 and vertical member 220 are not necessarily separate structures and instead can be contiguous portions of an integral structure. In exemplary embodiments, base 210 and vertical member 220 are contiguous sections of a single integral structure. Base 210 and vertical member 220 can also be two separate structures joined together. The means for joining base 210 and vertical member 220 can be the same as the means described to attach the water diffuser 200 to a water sports board. Such means include, adhesive, tape, one or more screws, for example one or two screws, one or more snap-joints, for example one or two snap-joints, and the like. Also, the means can also be a combination of two or more of such means as described with respect to the connection of the water diffuser 200 to the bottom surface of the water sports board.

The overall size of a water diffuser can vary as described herein. As long as the water diffusers are selected to be within the described sizes they will have the intended and described benefits. Selecting a particular size of a water diffuser 200 based on the ranges described herein can be based on different factors including, but not limited to, user's preference, the amount of turbulence and cavitation the water diffuser is meant to modulate, the size of wave the board is meant to ride, the shape of the tail, the size of the tail, the type of fin system, the number of fins, the types of fins, the conditions in which the board is meant to be ridden, or any combination of these factors. For example, the greater the turbulence and cavitation to modulate the larger the size of the water diffusers 200. Different factors can affect the amount of turbulence and cavitation. For example, it would be expected to have more turbulence and cavitation if the board is used in larger waves. Accordingly, if the board is to be used to ride larger waves, than the water diffusers would have to handle more turbulence and thus should be selected having a larger size than water diffusers to install on board to be used in smaller waves. Also, independent of the amount of turbulence, the size of the water diffusers 200 can be selected based on the fin system. For example, single fin and Twin fins systems can benefit from medium size water diffusers even though these fin systems are typically used on water sports boards meant for smaller waves. This is because in such boards, the water diffusers can double as a pivot point to enhance turning. These are simply illustrative examples of reasons to select the size of the desired water diffuser 200.

Base 210 can have any suitable shape having a front end 219 and a back end 218. In exemplary embodiments, a top-down view of base 210 can reveal a teardrop or lachrymiform shape 211. Alternative top-down view shapes for base 210 are also possible. Some exemplary embodiments are illustrated in FIG. 3B. Front end 219 can be wider than a pointed end. Front end 219 can be narrower than back end 218. In other words, from a top-down view, front end 219 can have a width that is smaller than the width of back end 218. The top-down view shape of base 210 can also include shapes were the front end 219 and back end 218 are similar in shape, size, or both. Alternative top-down view shapes for base 210 that include a front end 219 that is narrower than a back end 218 similar to the teardrop shape 211 can also be employed. For example, triangular shapes, polygonal shapes, and irregular elliptical shapes, and combinations thereof can be used. Alternative top-down view shape of base 210 where the front end 219 and back end 218 are similar include circular shapes, oval shapes, elliptical shapes, rectangular shapes, square shapes, polygonal shapes, or any combination thereof. Also, from a top-down view, front end 219, when wider than a pointed end, and back end 218 can independently be straight, curved, or a combination of both. When curved, they can be concave, convex, or a combination of both.

Base 210, and thus water diffuser 200, can have a longitudinal length ranging from about 0.7 inches to about 3 inches. If the length is shorter than 0.7 inches, the water diffuser will not be as effective. A length greater than 3 inches, can result in the water diffuser creating too much drag, depending on the water sports board on which it is used. The longitudinal length of base 210 can be defined as the length of a straight line that extends from the forward most edge or point on the front end 219 to the rearward most edge or point of the back end 218 of shape of base 210 when viewed from a top-down view. For example, base 210 can have a longitudinal length of about: 0.7 inches, 0.8 inches, 0.9 inches, 1.0 inches, 1.01 inches, 1.02 inches, 1.03 inches, 1.04 inches, 1.05 inches, 1.06 inches, 1.07 inches, 1.08 inches, 1.09 inches, 1.10 inches, 1.11 inches, 1.12 inches, 1.13 inches, 1.14 inches, 1.15 inches, 1.16 inches, 1.17 inches, 1.18 inches, 1.19 inches, 1.20 inches, 1.21 inches, 1.22 inches, 1.23 inches, 1.24 inches, 1.25 inches, 1.26 inches, 1.27 inches, 1.28 inches, 1.29 inches, 1.30 inches, 1.31 inches, 1.32 inches, 1.33 inches, 1.34 inches, 1.35 inches, 1.36 inches, 1.37 inches, 1.38 inches, 1.39 inches, 1.40 inches, 1.41 inches, 1.42 inches, 1.43 inches, 1.44 inches, 1.45 inches, 1.46 inches, 1.47 inches, 1.48 inches, 1.49 inches, 1.50 inches, 1.51 inches, 1.52 inches, 1.53 inches, 1.54 inches, 1.55 inches, 1.56 inches, 1.57 inches, 1.58 inches, 1.59 inches, 1.60 inches, 1.61 inches, 1.62 inches, 1.63 inches, 1.64 inches, 1.65 inches, 1.66 inches, 1.67 inches, 1.68 inches, 1.69 inches, 1.70 inches, 1.71 inches, 1.72 inches, 1.73 inches, 1.74 inches, 1.75 inches, 1.76 inches, 1.77 inches, 1.78 inches, 1.79 inches, 1.80 inches, 1.81 inches, 1.82 inches, 1.83 inches, 1.84 inches, 1.85 inches, 1.86 inches, 1.87 inches, 1.88 inches, 1.89 inches, 1.90 inches, 1.91 inches, 1.92 inches, 1.93 inches, 1.94 inches, 1.95 inches, 1.96 inches, 1.97 inches, 1.98 inches, 1.99 inches, 2.0 inches, 2.01 inches, 2.02 inches, 2.03 inches, 2.04 inches, 2.05 inches, 2.06 inches, 2.07 inches, 2.08 inches, 2.09 inches, 2.10 inches, 2.11 inches, 2.12 inches, 2.13 inches, 2.14 inches, 2.15 inches, 2.16 inches, 2.17 inches, 2.18 inches, 2.19 inches, 2.20 inches, 2.21 inches, 2.22 inches, 2.23 inches, 2.24 inches, 2.25 inches, 2.26 inches, 2.27 inches, 2.28 inches, 2.29 inches, 2.30 inches, 2.31 inches, 2.32 inches, 2.33 inches, 2.34 inches, 2.35 inches, 2.36 inches, 2.37 inches, 2.38 inches, 2.39 inches, 2.40 inches, 2.41 inches, 2.42 inches, 2.43 inches, 2.44 inches, 2.45 inches, 2.46 inches, 2.47 inches, 2.48 inches, 2.49 inches, 2.50 inches, 2.51 inches, 2.52 inches, 2.53 inches, 2.54 inches, 2.55 inches, 2.56 inches, 2.57 inches, 2.58 inches, 2.59 inches, 2.60 inches, 2.61 inches, 2.62 inches, 2.63 inches, 2.64 inches, 2.65 inches, 2.66 inches, 2.67 inches, 2.68 inches, 2.69 inches, 2.70 inches, 2.71 inches, 2.72 inches, 2.73 inches, 2.74 inches, 2.75 inches, 2.76 inches, 2.77 inches, 2.78 inches, 2.79 inches, 2.80 inches, 2.81 inches, 2.82 inches, 2.83 inches, 2.84 inches, 2.85 inches, 2.86 inches, 2.87 inches, 2.88 inches, 2.89 inches, 2.90 inches, 2.91 inches, 2.92 inches, 2.93 inches, 2.94 inches, 2.95 inches, 2.96 inches, 2.97 inches, 2.98 inches, 2.99 inches, or 3.0 inches.

Base 210, and thus water diffuser 200, can have a lateral width ranging from about 0.25 inches to about 1.0 inches. The lateral width of base 210 can be defined as its widest lateral dimension of the shape of base 210 when viewed from a top-down view. For example, base 210 can have a lateral width of about: 0.25 inches, 0.26 inches, 0.27 inches, 0.28 inches, 0.29 inches, 0.3 inches, 0.31 inches, 0.32 inches, 0.33 inches, 0.34 inches, 0.35 inches, 0.36 inches, 0.37 inches, 0.38 inches, 0.39 inches, 0.4 inches, 0.41 inches, 0.42 inches, 0.43 inches, 0.44 inches, 0.45 inches, 0.46 inches, 0.47 inches, 0.48 inches, 0.49 inches, 0.5 inches, 0.51 inches, 0.52 inches, 0.53 inches, 0.54 inches, 0.55 inches, 0.56 inches, 0.57 inches, 0.58 inches, 0.59 inches, 0.6 inches, 0.61 inches, 0.62 inches, 0.63 inches, 0.64 inches, 0.65 inches, 0.66 inches, 0.67 inches, 0.68 inches, 0.69 inches, 0.7 inches, 0.71 inches, 0.72 inches, 0.73 inches, 0.74 inches, 0.75 inches, 0.76 inches, 0.77 inches, 0.78 inches, 0.79 inches, 0.8 inches, 0.81 inches, 0.82 inches, 0.83 inches, 0.84 inches, 0.85 inches, 0.86 inches, 0.87 inches, 0.88 inches, 0.89 inches, 0.9 inches, 0.91 inches, 0.92 inches, 0.93 inches, 0.94 inches, 0.95 inches, 0.96 inches, 0.97 inches, 0.98 inches, 0.99 inches, or 1 inch.

For example, a teardrop shape 211 can be identified from a top-down view. As illustrated in FIGS. 2A-2E, a teardrop or lachrymiform shape refers to the shape that is like that of a dropping tear. Particularly, a teardrop shape includes a pointed shape at front end 219, i.e. pointed end 209, and a curved shape at back end 218, i.e. round end 208. The teardrop shape is referenced throughout this description for illustrative purposes only and for ease of reference. As described earlier, base 210 can have different designs and thus not limited to the teardrop shape. Thus, references to pointed end 209 and round end 208, should be understood as illustrative of the teardrop shape but indicative of front end 219 and back end 218 respectively in the more generic sense. The round end 208 can be circular or elliptical. In teardrop shape 211, for example, the length can be defined as the length of a straight line that evenly bisects the vertex of pointed end 209, and extends from pointed end 209 to round end 208. In the exemplary teardrop shape 211, the width can be equivalent to the diameter of the round end 208. Thus, a teardrop shaped base 210 can have a length extending from pointed end 209 to round end 208 ranging from about 0.7 inches to about 3.0 inches, and a width equivalent to the diameter of round end 208 ranging from about 0.25 inches to about 1.0 inches. In an exemplary embodiment, base 210 can have a teardrop shape having a length of 1.03 inches and a width of 0.3 inches.

It should be recognized that the longitudinal length of base 210 is also the overall longitudinal length of the water diffuser 200. Moreover, the lateral width of base 210 is also the widest point and thus the overall lateral width of water diffuser 200. As such, the measurements provided for the longitudinal length and lateral width of base 210 are also the measurements for the longitudinal length and widest lateral width of the overall water diffuser 200.

Base 210 can include sidewall 213 that extend from perimeter 212 of base 210 to vertical member 220 at bottom end 221 of vertical member 220. The vertical length of sidewall 213 is not particularly limited and can be designed depending on the desired size of the overall water diffuser. Sidewall 213 can be tapered. Sidewall 213 can have a convex structure. Sidewall 213 can have a concave structure. Sidewall 213 can also include a flat portion along at least a portion of its perimeter before extending upward. Sidewall 213 can also include any combination of tapered, convex, concave, and flat portions.

Figure 3A:
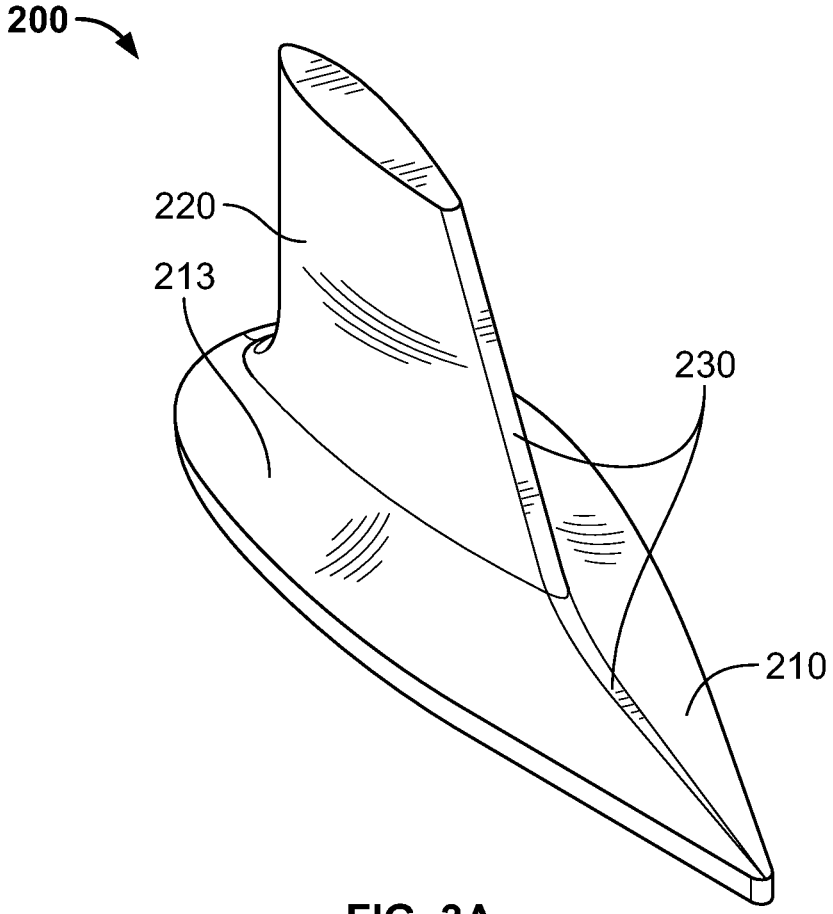
FIG. 3A is a perspective view of an exemplary embodiment of a water diffuser in accordance with the present invention.
Figure 3B:
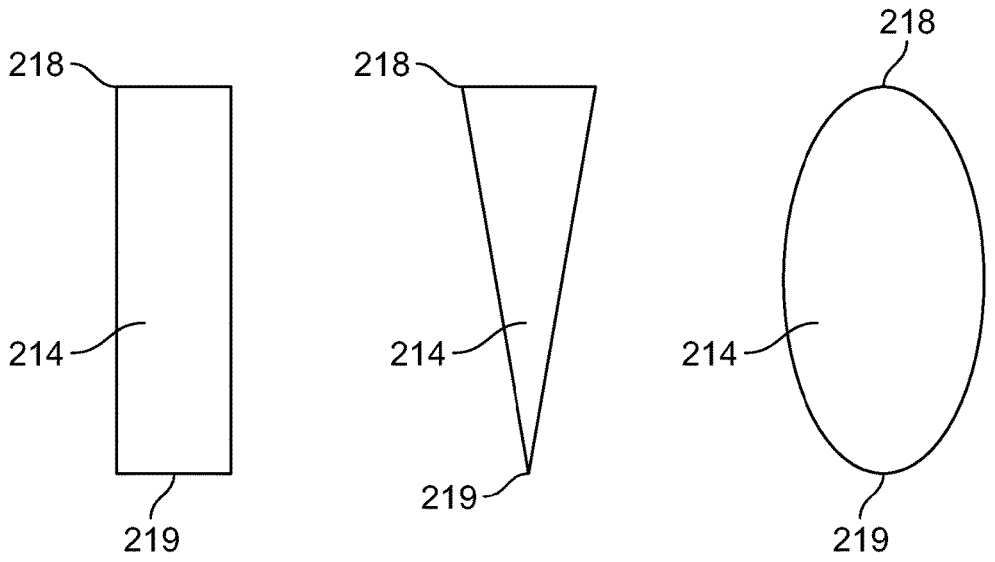
FIG. 3B illustrate exemplary shapes of the underside surface of a water diffuser other than a teardrop shape.

For example, as illustrated in FIG. 3A, sidewall 213 can include a flat portion along the tapering of a teardrop shape base 210. In combination with the flat portion, sidewall 213 can also include a tapering concave contour extending from the flat portion to the vertical member 220. Also, in combination with the flat portion, sidewall 213 can include a tapering concave contour that extends from the perimeter 212 of the non-tapering portion of the teardrop shape base 210 to the vertical member 220.

Figure 2A:
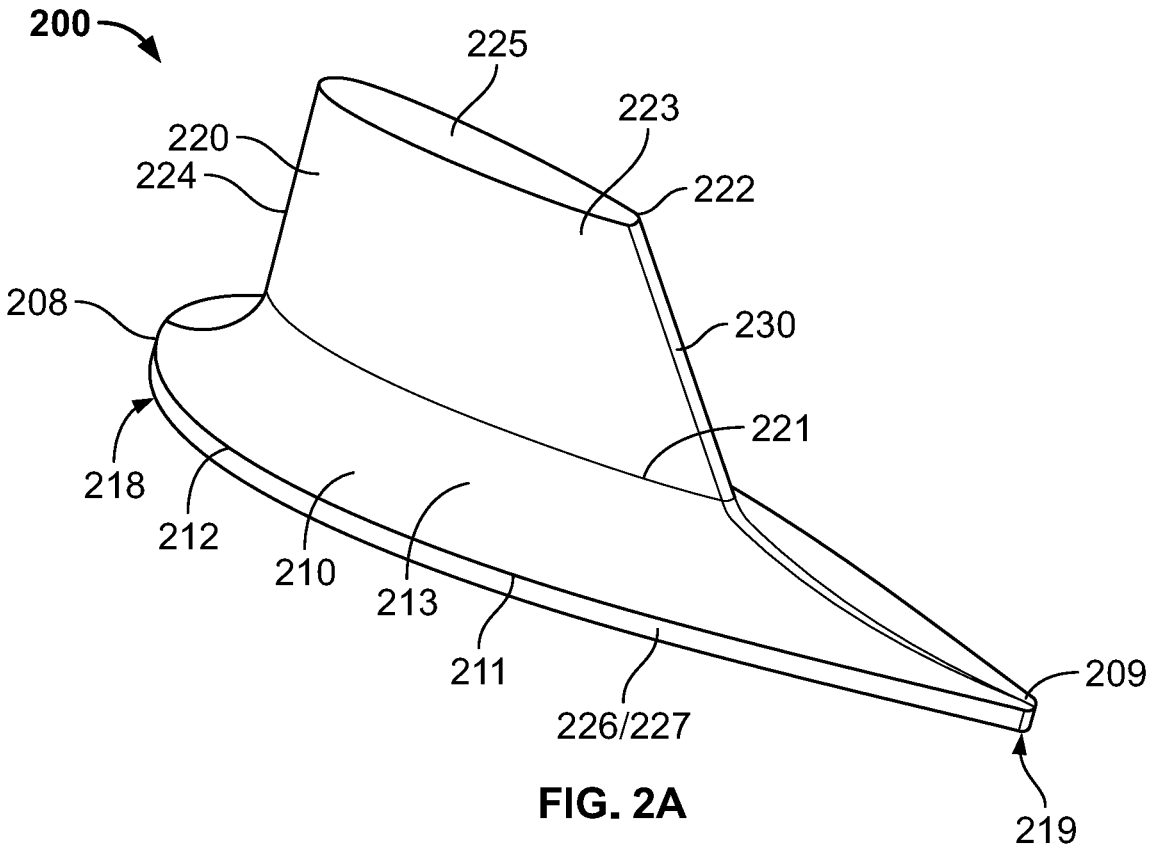
FIGS. 2A-2J illustrate an embodiment of the water diffuser in accordance with the present invention and exemplary means to attach the water diffuser to a water sports board.
Figure 2B:
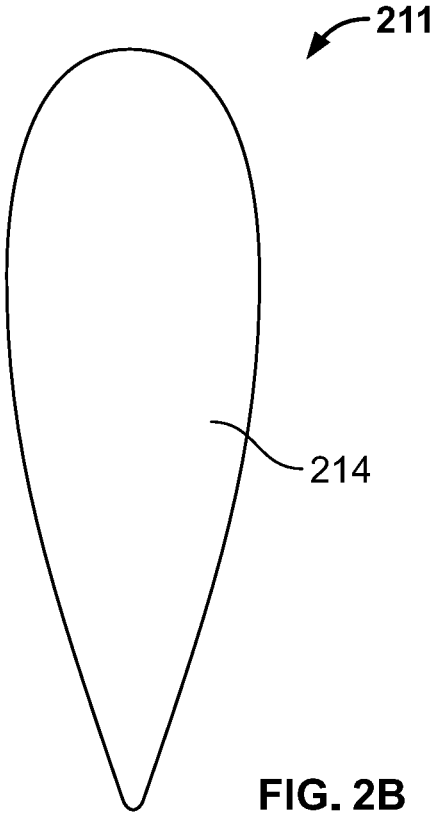
Figure 2C:
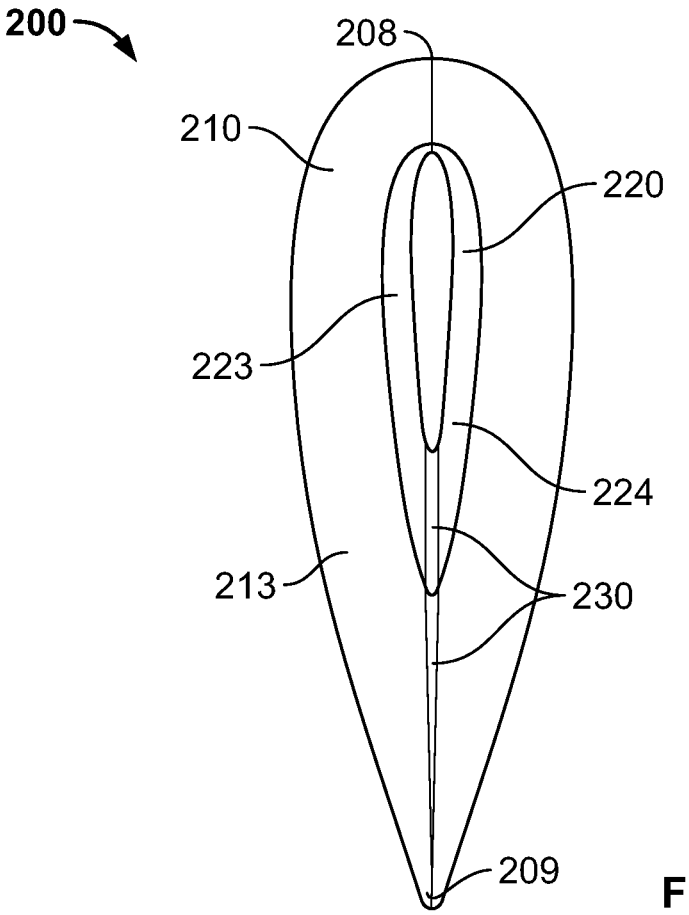

The underside of base 210, i.e. the portion opposite the vertical member 220, can be underside surface 214 as illustrated in FIG. 2B. In embodiments, when water diffuser 200 is provided on a water sports board, underside surface 214 faces the surface of the water sports board to which the water diffuser 200 is attached. Underside surface 214 can be flat or contoured. Underside surface 214 can be polished or roughened. Underside surface 214 can be polished or left untreated. Underside surface 214 can be designed to affix the water diffuser to a water sports board. For example, underside surface 214 can be coated with an adhesive 226. Any suitable adhesive that can withstand the pressure exerted on the water diffuser and keep the water diffuser attached to the water sports board can be used. An exemplary adhesive can include an epoxy adhesive. In one embodiment, the adhesive can be the E6000 Industrial Strength Adhesive made by Eclectic Products, Inc., Manufacturing Facility at 101 Dixie Mae Drive, Pineville, La. The adhesive can be applied as a uniform or non-uniform layer on underside surface 214. For example, an adhesive layer about 0.03 in thick can be uniformly applied to underside surface 214. The thickness of the adhesive layer is not particularly limited and can generally range from about 0.02 in to about 0.05 in. An adhesive that is thicker than this range is not preferable because it can lead to too much play in the water diffuser. An adhesive that is thinner than the recited range is also not preferable because it could provide insufficient bonding strength and thus may increase the risk of detaching.

Alternative means to attach or install a water diffuser to a water sports board can also be used. The water diffuser can be attached using one or more screws. In exemplary embodiments, a water diffuser can be attached using one screw, two screws, three screws, four screws. The number of screws not limited other than by the size of the water diffuser. Any suitable screw may be used. In an exemplary embodiment, the one or more screws can include one or more grub screws 241. As for example illustrated in FIGS. 2F-21, when using one or more screws 241, one or more screw holes 240 to accommodate the one or more screws 241 may be provided through base 210 extending from the surface of side wall 213 through underside surface 214. In exemplary embodiments, one or more screw holes 240 can be provided such that it extends through both vertical member 220 and base 210. The number of screw holes 240 can be the same or different from the number of screws 241. In exemplary embodiments, a water diffuser can include one, two, three, four, or five screw holes. The number of screw holes is not limited other than by the size of the water diffuser. Likewise, one or more corresponding screw holes 245 may be provided in the bottom surface of the water sports board. The number of screw holes 245 at the bottom surface of the water sports board is not particularly limited and can be set depending on the desired flexibility of arrangements. In exemplary embodiments, the bottom surface of the water sports board can include one, two, three, four, five, six, seven, eight, nine, ten, twelve, fourteen, fifteen, sixteen, eighteen, twenty, twenty one, twenty two, twenty four, twenty five, twenty six, twenty seven, twenty eight, or thirty screw holes 245. As such, the screw would be able to secure a water diffuser 200 to the bottom surface of the water sports board.

The water diffuser can be attached using one or more snap-joints. In exemplary embodiments, a water diffuser can include one, two, three, four, or five snap-joints. The number of snap joints is not limited other than by the size of the water diffuser. Each snap joint can include one or more lip portions 250 protruding from the base 210, and preferable from underside surface 214, that snap-fit into one or more slots 255 provided in the bottom surface of the water sports board. In exemplary embodiments, a water diffuser can include one, two, three, four, or five lip portions 250. The number of lip portions 250 is not limited other than by the size of the water diffuser. The number of slots 255 at the bottom surface of the water sports board is also not particularly limited and can be set depending on the desired flexibility of arrangements. In exemplary embodiments, the bottom surface of the water sports board can include one, two, three, four, five, six, seven, eight, nine, ten, twelve, fourteen, fifteen, sixteen, eighteen, twenty, twenty one, twenty two, twenty four, twenty five, twenty six, twenty seven, twenty eight, or thirty slots 255.

The water diffuser can be attached using tape 227. The tape can be a double sided adhesive tape. The tape can be of any suitable thickness that can provide strong bonding of the water diffuser. In exemplary embodiments, the tape can be a double sided adhesive tape with a thickness ranging from about 0.02 inches to about 0.05 inches, similar to the adhesive layer described earlier.

Also, any combination of two or more of the above means to attach the water diffuser to the water sports board can be used in combination. For example, adhesive and one or more screws can be used. For example, adhesive and tape can be used. For example, tape and one or more screws can be used. For example, adhesive and one or more snap-joints can be used. For example, tape and one or more snap-joints can be used. For example, one or more screws and one or more snap-joints can be used. For example, adhesive plus one or more screws and one or more snap-joints can be used. For example, tape plus one or more screws and one or more snap joints can be used. For example, adhesive plus tape and one or more screws can be used. For example, adhesive plus tape and one or more snap-joints can be used. For example, adhesive plus tape, one or more snap-joints, and one or more screws can be used. When tape and adhesive are both used in combination, their combined thickness can be the same as if using only an adhesive or tape. The same considerations regarding thickness apply as discussed above with respect to adhesive and tape individually when the two are used in combination. In an exemplary embodiment, the tape and adhesive have a combined thickness of 0.03 inches.

Figure 2D:
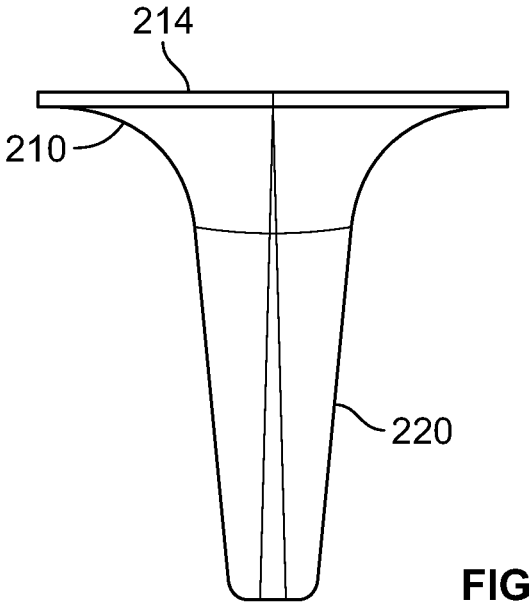
Figure 2E:
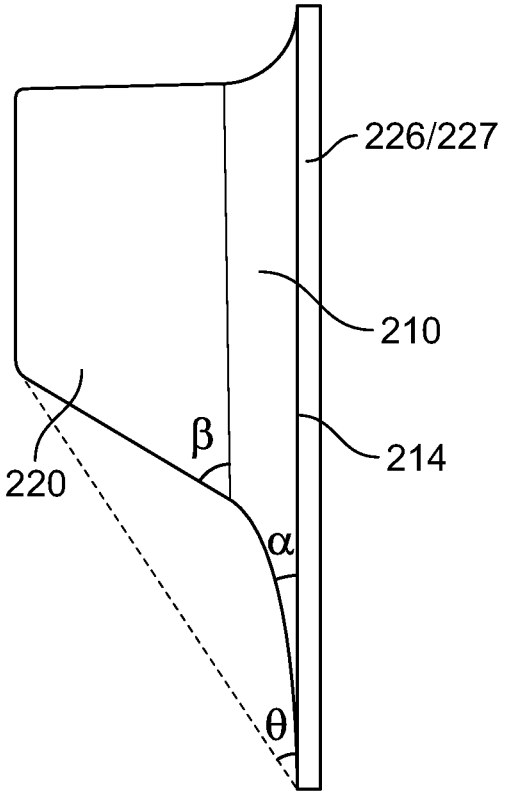
Figure 2F:
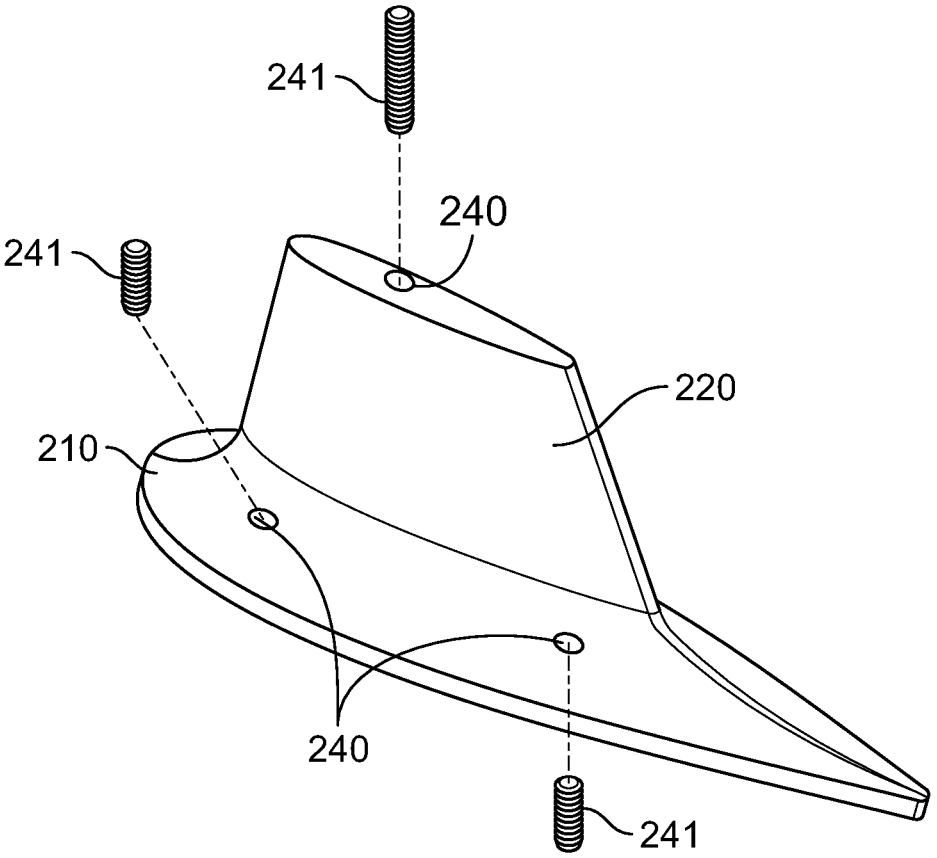
Figure 2G:
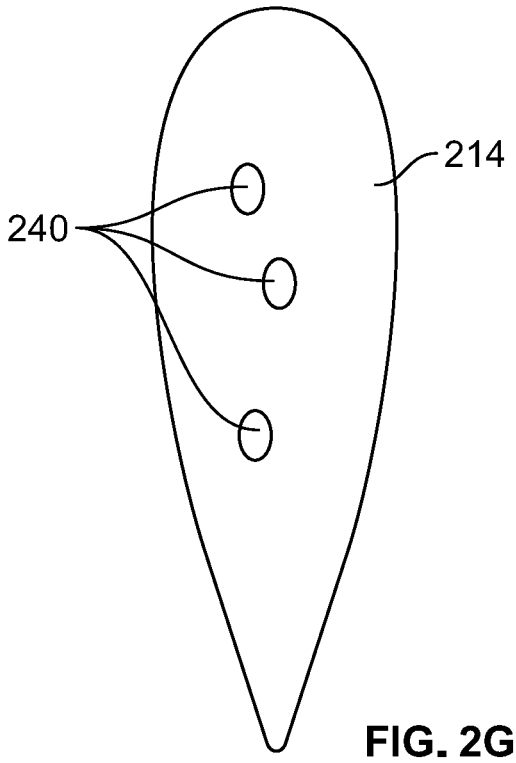
Figure 2H:
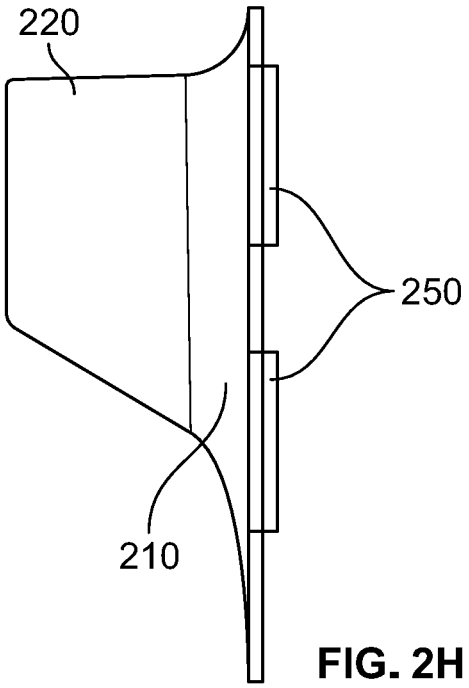
Figure 2I:
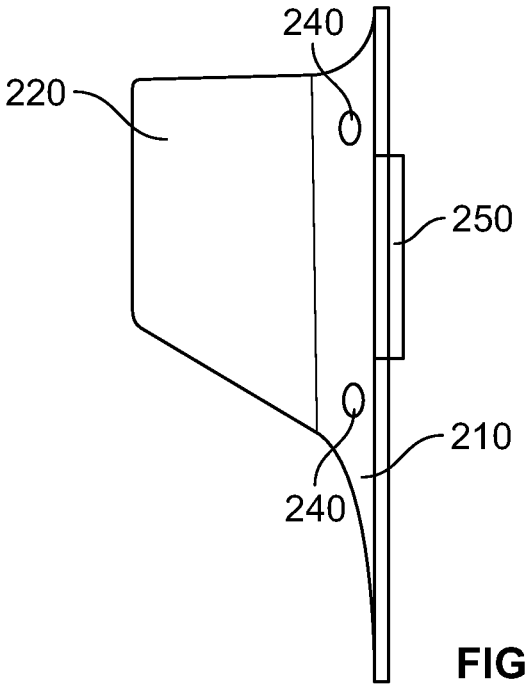
Figure 2J:
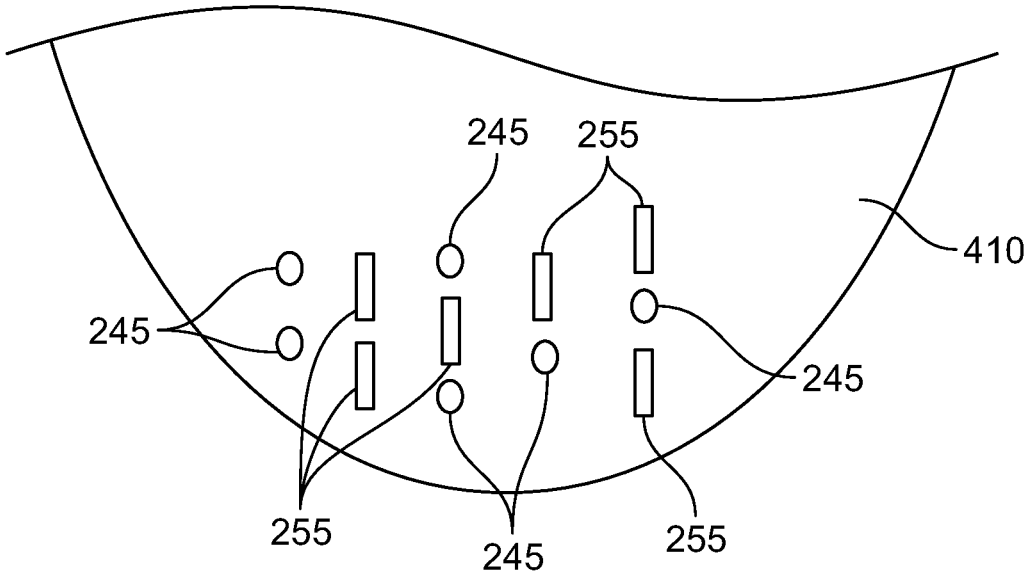

The above attachment means can be used to permanently attach or install one or more water diffusers 200 to a water sports board. The above attachment means can also be used to detachably attach or install one or more water diffusers 200 to a water sports board. Having a detachable or releasable attachment or connection can provide the advantage to install and uninstall one or more water diffusers 200 as desired. The releasable connection are preferably strong enough to withstand the water pressure coming into contact with the one or more water diffusers 200. Any of the above mentioned attachment means, including adhesive, screws, snap-joints, and tape can be made into a detachable or releasable joint. Likewise, any of the previously listed combination of attachment means can be made as releasable or permanent joints, connections, or attachments. Screws and snap joints are ubiquitous detachable or releasable connections often also used for fins. Likewise, detachable or releasable adhesives and tapes can be implemented without limitations. As illustrated in FIG. 2J, in embodiments using screws, snap-joints, or a combination of both, the bottom surface of the water sports board can include one or more screw holes 245, one or more slots 255, or a combination of both at different locations to accommodate the screws, snap-joints, or a combination of both as exemplified for one or more water diffusers so as to allow for different arrangements and numbers of water diffusers installed on the bottom surface.

In exemplary embodiments, instead of attaching one or more water diffuser 200 to a finished water sports board, it is also within the scope of the invention to incorporate one or more water diffusers in the body of the water sports board and thus be an integral part of the water sports board. For example, the water diffusers can be fixed to a board prior to glassing. The same means to attach the water diffusers to the board described above can be used to fix the water diffuser to the pre-glassed board. The glassing can then be applied to coat over the water diffuser and thus make them integral to the water sports board. In some embodiments, the water diffusers can also be formed in the board blank during the shaping of the board and then glassed, instead of forming the water diffusers separately and attaching them to a shaped board prior to glassing. In some embodiments, the water diffusers can be formed with the glassing. For example, when during the glassing stage of a water sports board, glassing material can be deposited at the desired location by dripping additional glassing material, for example polyester or epoxy resin with or without fiberglass cloth mixed in, to form protruding structures reproducing or approximating as close as possible the water diffuser sizes and shapes as generally described herein. Once the glassing material hardens the water diffuser is made. The water diffuser thus is made of glassing material. As such, the water diffuser is made as an integral part water sports board by being part of the glassing of the water sports board. It is recognized that if a dripping method is used, the exact shapes otherwise described herein might not be achieved. These approximate shapes should be viewed falling within the scope of the described invention.

Vertical member 220 can extend from base 210. In exemplary embodiments, vertical member 220 extends from bottom end 221 where it meets side wall 213 to a distal end 222. Vertical member 220 can have any suitable shape for the intended purpose. Vertical member 220 can include sidewalls 223 and 224. Sidewalls 223 and 224 can be a single contiguous sidewall. Sidewalls 223 and 224 can be two distinct sidewalls jointed together to define vertical member 220. Sidewalls 223 and 224 can be straight. Sidewalls 223 and 224 can be convex. Sidewalls 223 and 224 can be concave. Sidewalls 223 and 224 can have similar or different contours. In exemplary embodiments, sidewalls 223 and 224 are similar. Sidewalls 223 and 224 can also be symmetric or asymmetric. Also, sidewalls 223 and 224 can be parallel. Alternatively, sidewalls 223 and 224 can define a tapering profile. For example, sidewalls 223 and 224 can be closer toward distal end 222 of vertical member 220 and farther apart at bottom end 221 where they meet sidewall 213. In exemplary embodiments the thickness of vertical member 220 can range from about 0.1 inches to about 1 inches. For example, the thickness of vertical member 220 can be about: 0.1 inches, 0.2 inches, 0.3 inches, 0.4 inches, 0.5 inches, 0.6 inches, 0.7 inches, 0.8 inches, 0.9 inches, or 1.0 inches.

In exemplary embodiments, sidewalls 223 and 224 have similar shapes and are symmetric to define vertical member 220 that is symmetrical with respect to a vertical plane that dissects vertical member 220 in two parallel, vertical, mirroring halves.

As illustrated in FIGS. 2A-2E and FIG. 3A, exemplary vertical member 220 can have a hydrofoil design with convex tapering sidewalls 223 and 224. The horizontal cross-section of vertical member 220 can have an elongated elliptical shape that narrows going from bottom end 221 to distal end 222. The elongated elliptical shape may be wider at one end than the other. In an exemplary embodiment, the vertical member 220 has a hydrofoil design with a horizontal cross-section having an elongated elliptical shape that is wider at one end and narrower at the other. In exemplary embodiments, the horizontal cross-section is a teardrop shape. The horizontal cross-section can also be a combination of an elliptical shape and a teardrop shape. For example, as illustrated in FIG. 3A, vertical member 220 can be arranged such that the wide end section of the vertical member 220 can be closer to the back end 218, illustrated as round end 208, of base 210, and the narrow end section of vertical member 220 can be closer to the front end 219, in illustrative embodiments pointed end 209, of base 210.

The width of vertical member 220 at distal end 222 when vertical member 220 includes a truncated profile at distal end 222, when distal end 222 includes a flat surface, or both, can range from about 0.06 inches to about 0.40 inches. The width of vertical member 220 at distal end 222 is defined as the largest horizontal distance at distal 222 between sidewalls 223 and 224. For example, the width of the vertical member 220 can be about: 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, 0.20 inches, 0.21 inches, 0.22 inches, 0.23 inches, 0.24 inches, 0.25 inches, 0.26 inches, 0.27 inches, 0.28 inches, 0.29 inches, 0.30 inches, 0.31 inches, 0.32 inches, 0.33 inches, 0.34 inches, 0.35 inches, 0.36 inches, 0.37 inches, 0.38 inches, 0.39 inches, or 0.40 inches. In an exemplary embodiment, as illustrated in FIG. 2D, the width of vertical member 220 at the distal end 222 can be 0.06 in.

The length of vertical member 220 at distal end 222 when vertical member 220 includes a truncated profile at distal end 222, when distal end 222 includes a flat surface, or both, can range from about 0.3 inches to about 1.0 inches. The length of vertical member 220 at distal end 222 is defined as the horizontal distance, perpendicular to the width of vertical member 220 at distal end 222, extending from front edge 230 to the point at distal end 222 that is closest to back end 218. For example, the length of distal end 222 can be about: 0.3 inches, 0.35 inches, 0.4 inches, 0.45 inches, 0.5 inches, 0.55 inches, 0.6 inches, 0.65 inches, 0.70 inches, 0.71 inches, 0.72 inches, 0.73 inches, 0.74 inches, 0.75 inches, 0.76 inches, 0.77 inches, 0.78 inches, 0.79 inches, 0.8 inches, 0.81 inches, 0.82 inches, 0.83 inches, 0.84 inches, 0.85 inches, 0.86 inches, 0.87 inches, 0.88 inches, 0.89 inches, 0.9 inches, 0.91 inches, 0.92 inches, 0.93 inches, 0.94 inches, 0.95 inches, 0.96 inches, 0.97 inches, 0.98 inches, 0.99 inches, or 1.0 inches.

The length of vertical member 220 at bottom end 221 can range from about 0.7 inches to about 1.8 inches. The length of vertical member 220 at bottom end 221 is defined as the horizontal distance at bottom end 221 extending from front edge 230 to a point at bottom end 221 closest to back end 218. For example, For example, the length of bottom end 221 can be about: 0.70 inches, 0.71 inches, 0.72 inches, 0.73 inches, 0.74 inches, 0.75 inches, 0.76 inches, 0.77 inches, 0.78 inches, 0.79 inches, 0.8 inches, 0.81 inches, 0.82 inches, 0.83 inches, 0.84 inches, 0.85 inches, 0.86 inches, 0.87 inches, 0.88 inches, 0.89 inches, 0.90 inches, 0.91 inches, 0.92 inches, 0.93 inches, 0.94 inches, 0.95 inches, 0.96 inches, 0.97 inches, 0.98 inches, 0.99 inches, 1.0 inches, 1.01 inches, 1.02 inches, 1.03 inches, 1.04 inches, 1.05 inches, 1.06 inches, 1.07 inches, 1.08 inches, 1.09 inches, 1.10 inches, 1.11 inches, 1.12 inches, 1.13 inches, 1.14 inches, 1.15 inches, 1.16 inches, 1.17 inches, 1.18 inches, 1.19 inches, 1.20 inches, 1.21 inches, 1.22 inches, 1.23 inches, 1.24 inches, 1.25 inches, 1.26 inches, 1.27 inches, 1.28 inches, 1.29 inches, 1.30 inches, 1.31 inches, 1.32 inches, 1.33 inches, 1.34 inches, 1.35 inches, 1.36 inches, 1.37 inches, 1.38 inches, 1.39 inches, 1.40 inches, 1.41 inches, 1.42 inches, 1.43 inches, 1.44 inches, 1.45 inches, 1.46 inches, 1.47 inches, 1.48 inches, 1.49 inches, 1.50 inches, 1.51 inches, 1.52 inches, 1.53 inches, 1.54 inches, 1.55 inches, 1.56 inches, 1.57 inches, 1.58 inches, 1.59 inches, 1.60 inches, 1.61 inches, 1.62 inches, 1.63 inches, 1.64 inches, 1.65 inches, 1.66 inches, 1.67 inches, 1.68 inches, 1.69 inches, 1.70 inches, 1.71 inches, 1.72 inches, 1.73 inches, 1.74 inches, 1.75 inches, 1.76 inches, 1.77 inches, 1.78 inches, 1.79 inches, or 1.80 inches.

The shape of vertical member 220 at distal end 222, i.e. the end distal from the base 210, is not particularly limited. For example, at distal end 222 vertical member 220 can be tapering, end at a point, have a horizontal surface, include a flat or planar portion, have an uneven surface, or any combination of two or more thereof. In embodiments, vertical member 220 may have a truncated profile at distal end 222. Distal end 222 can include a flat surface 225. In embodiments, as for example illustrated in FIGS. 2A-2E and FIG. 3A, at distal end 222 vertical member 220 includes a truncated profile and includes a flat surface 225. The flat surface 225 can be a horizontal surface that is parallel to underside surface 214 of base 210. Flat surface 225 can extend along the full length of vertical member 220 or along only a portion of the length of vertical member 220. Having a vertical member 220 with a truncated profile with a flat surface 225 at distal end 222 can be advantageous because it provides vertical member 220 with an overall stronger and more resilient structure without a thin end portion that can be more likely to break. Also, by designing vertical member 220 have a truncated profile and include a flat surface 225 at distal end 222, the water diffuser 200 can help improve lift.

The overall height of the water diffuser 200, which includes the combined height of base 210, with or without an adhesive layer on underside surface 214, and vertical member 220 can range from about 0.1 inches to about 2.0 inches. For example the overall height of water diffuser 200 can be about: 0.10 inches, 0.11 inches, 0.12 inches, 0.13 inches, 0.14 inches, 0.15 inches, 0.16 inches, 0.17 inches, 0.18 inches, 0.19 inches, 0.2 inches, 0.21 inches, 0.22 inches, 0.23 inches, 0.24 inches, 0.25 inches, 0.26 inches, 0.27 inches, 0.28 inches, 0.29 inches, 0.3 inches, 0.31 inches, 0.32 inches, 0.33 inches, 0.34 inches, 0.35 inches, 0.36 inches, 0.37 inches, 0.38 inches, 0.39 inches, 0.4 inches, 0.41 inches, 0.42 inches, 0.43 inches, 0.44 inches, 0.45 inches, 0.46 inches, 0.47 inches, 0.48 inches, 0.49 inches, 0.5 inches, 0.51 inches, 0.52 inches, 0.53 inches, 0.54 inches, 0.55 inches, 0.56 inches, 0.57 inches, 0.58 inches, 0.59 inches, 0.6 inches, 0.61 inches, 0.62 inches, 0.63 inches, 0.64 inches, 0.65 inches, 0.66 inches, 0.67 inches, 0.68 inches, 0.69 inches, 0.7 inches, 0.71 inches, 0.72 inches, 0.73 inches, 0.74 inches, 0.75 inches, 0.76 inches, 0.77 inches, 0.78 inches, 0.79 inches, 0.8 inches, 0.81 inches, 0.82 inches, 0.83 inches, 0.84 inches, 0.85 inches, 0.86 inches, 0.87 inches, 0.88 inches, 0.89 inches, 0.9 inches, 0.91 inches, 0.92 inches, 0.93 inches, 0.94 inches, 0.95 inches, 0.496 inches, 0.97 inches, 0.98 inches, 0.99 inches, 1.0 inches, 1.01 inches, 1.02 inches, 1.03 inches, 1.04 inches, 1.05 inches, 1.06 inches, 1.07 inches, 1.08 inches, 1.09 inches, 1.10 inches, 1.11 inches, 1.12 inches, 1.13 inches, 1.14 inches, 1.15 inches, 1.16 inches, 1.17 inches, 1.18 inches, 1.19 inches, 1.20 inches, 1.21 inches, 1.22 inches, 1.23 inches, 1.24 inches, 1.25 inches, 1.26 inches, 1.27 inches, 1.28 inches, 1.29 inches, 1.30 inches, 1.31 inches, 1.32 inches, 1.33 inches, 1.34 inches, 1.35 inches, 1.36 inches, 1.37 inches, 1.38 inches, 1.39 inches, 1.40 inches, 1.41 inches, 1.42 inches, 1.43 inches, 1.44 inches, 1.45 inches, 1.46 inches, 1.47 inches, 1.48 inches, 1.49 inches, 1.50 inches, 1.51 inches, 1.52 inches, 1.53 inches, 1.54 inches, 1.55 inches, 1.56 inches, 1.57 inches, 1.58 inches, 1.59 inches, 1.60 inches, 1.61 inches, 1.62 inches, 1.63 inches, 1.64 inches, 1.65 inches, 1.66 inches, 1.67 inches, 1.68 inches, 1.69 inches, 1.70 inches, 1.71 inches, 1.72 inches, 1.73 inches, 1.74 inches, 1.75 inches, 1.76 inches, 1.77 inches, 1.78 inches, 1.79 inches, 1.80 inches, 1.81 inches, 1.82 inches, 1.83 inches, 1.84 inches, 1.85 inches, 1.86 inches, 1.87 inches, 1.88 inches, 1.89 inches, 1.90 inches, 1.91 inches, 1.92 inches, 1.93 inches, 1.94 inches, 1.95 inches, 1.96 inches, 1.97 inches, 1.98 inches, 1.99 inches, or 2.0 inches. For example, the height of a water diffuser extending from underside surface 214 to distal end 222 can be 0.38 inches. As illustrated in FIG. 2E, in an embodiment in which a 0.03 inches thick adhesive layer is provided on bottom underside surface 214 of base 210, the total height of a water diffuser including from adhesive layer 226 to surface 225 can be 0.41 inches.

Water diffuser 200 can also include a front edge 230. Front edge 230 can extend from front end 219, or illustrated pointed end 209, to distal end 222. Front edge 230 can be a narrow flat portion. The width of front edge 230 can also widen going from front end 219, or illustrated pointed end 209, to distal end 222. At its widest point, the narrow flat portion can range from about 0.01 inches to about 0.25 inches. For example, the widest point can be about: 0.10 inches, 0.11 inches, 0.12 inches, 0.13 inches, 0.14 inches, 0.15 inches, 0.16 inches, 0.17 inches, 0.18 inches, 0.19 inches, 0.2 inches, 0.21 inches, 0.22 inches, 0.23 inches, 0.24 inches, or 0.25 inches. Where front edge 230 meets front end 219, or illustrated pointed end 209, the flat portion may be a line. When the water diffuser 200 is installed on a water sports board, front edge 230 faces away from the tail edge of the water sports board. When the water diffuser 200 is installed on a water sports board, the front edge 230 faces toward the nose of the water sports board. Accordingly, the teardrop shaped base 210 of the water diffuser has also the pointed end 209 directed toward the nose of the water sports board, while the round end 208 is closest to the tail edge of the water sports board. Likewise, the vertical member 220 can be arranged to have a narrower horizontal cross-section toward the nose of the water sports board.

As illustrated in FIGS. 2A-2E and FIG. 3A, along sidewall 213 of base 210, front edge 230 can extend from front end 219, or illustrated pointed end 209, to bottom end 221 of vertical member 220. Particularly, front edge 230 can be arranged to evenly dissect front end 219, illustrated as pointed end 209, and evenly split sidewall 213 between front end 219, illustrated as pointed end 209, and bottom end 221 into two mirroring halves. Along vertical member 220, front edge 230 can extend from bottom end 221 to distal end 222 between sidewalls 223 and 224. For example, front edge 230 can be located so as to evenly separate sidewalls 223 and 224. Front edge 230 can extend in a straight vertical direction from front end 219, illustrated as pointed end 209, to distal end 222. In embodiments, front edge 230 is the forward-most portion of water diffuser 200 that faces the nose of the water sports board when installed.

The slope of front edge 230 along the sidewall 213 of base 210 can be different from the slope of the front edge 230 along the vertical member 220. The portion of front edge 230 along sidewall 213 can have a first slope, identified in FIG. 2E as angle α, and the portion of front edge 230 along the vertical member 220 can have a second slope, identified in FIG. 2E as angle β. In exemplary embodiments, the slope of front edge 230 along vertical member 220 is steeper than the slope of front edge 230 along sidewall 213 of base 210. For example, the α can range from about 10° to about 20°, while the β can range from about 40° to about 60°. These ranges are only exemplary and can be varied. The overall angle of elevation, identified in FIG. 2E as θ, between front end 219, illustrated as pointed end 209, to the front portion of distal end 222, can range from about 30° to about 45°. Having the overall angle of elevation θ be less than about 30° or greater than about 45° could negatively impact the water diffuser's ability to provide lift. Also, as illustrated in FIGS. 2A-2E, front edge 230 can define an overall concave contour as it extends from front end 219, illustrated as pointed end 209, to distal end 222. Also, the concave contour defined by front edge 230 can be curved. The degree of curvature can be defined to meet the above stated angles α, β, θ, or any combination thereof.

It should be appreciated that although the overall contour of front edge 230 is concave, portions of front edge 230 may have different contours. For example, any portion of front edge 230 that extends along sidewall 213 can be convex, concave, straight, or a combination thereof. Likewise, any portion of front edge 230 extending along vertical member 230 can be convex, concave, straight, or a combination thereof. In an exemplary embodiment, as illustrated in FIG. 3A, the portion of front edge 230 along sidewall 213 is concave, while the portion of front edge 230 along vertical member 220 is straight, and still, overall front edge 230 defines a concave contour.

Front edge 230 can smoothly transition from base 210 to vertical member 220. For example, front edge 230 can have a curved concave contour in which the front edge 230 defines a curve as it transitions from a first slope to a second slope. Alternatively, front edge 230 can have an angled contour. For example, front edge 230 can have a first portion having a first slope that is different from a second slope of a second portion, and the first and second portions meet to form an obtuse angle. In an exemplary embodiment, the obtuse angle is provided at bottom end 221 where the sidewall 213 meets vertical member 220. Having a front edge 230 with a concave contour can promote lift. This is particularly so when a concave front edge 230 is combined with a vertical member 220 that has a truncated profile and includes a flat surface 225 at distal end 222. However, in embodiments, front edge 230 can have a straight profile or a convex profile.

One or more water diffusers 200 can be arranged into a desired configuration to form a water diffuser system 400. Referencing FIGS. 4A-4E, the configuration of water diffuser system 400 can vary depending on the type of board. The number of water diffusers 200 included in water diffuser system 400 is not particularly limited. However, it should be recognized that having too great a number of water diffusers 200 could lead to increased drag and thus negatively affect the performance of a water sports board. In exemplary embodiments, water diffuser system 400 can include as few as a single water diffuser 200, or as many as ten water diffusers 200. For example, the water diffuser system 400 can include one water diffuser, two water diffusers, three water diffusers, four water diffusers, five water diffusers, six water diffusers, seven water diffusers, eight water diffusers, nine water diffusers, or ten water diffusers. For illustrative purposes, FIGS. 4A-4E illustrate water diffuser system 400 that includes two water diffusers, three water diffusers, or four water diffusers.

Water diffuser system 400 can include a set of water diffusers 200 arranged on the bottom surface, near the edge of the tail of a water sports board. The water diffusers 200 can be placed in a row. The water diffusers 200 can be placed to be offset from each other. A combination of these arrangements can also be employed. For example, in embodiments, one set of water diffusers 200 can be arranged in parallel on one row, while another set of water diffusers 200 are arranged in parallel on a different row.

The water diffuser system 400 can include one or more water diffusers 200 independently installed by means as described earlier. Alternatively, as illustrated in FIGS. 4F-4J, water diffuser system 400 can include two or more water diffusers 200 can be fixed to a frame 470 that is attached or joined to the board.

Frame 470 can be made of the same material as used to form water diffuser 200. Also, similar manufacturing processes can be used to form frame 470 as described for manufacturing water diffuser 200.

The water diffusers 200 can be attached to frame 470 by any means previously described for attaching water diffusers 200 to a water sports board. The water diffusers 200 can be permanently attached to frame 470 or detachably attached to frame 470. Alternatively, water diffusers 200 and frame 470 can be formed as an integral structure. Any manufacturing method previously described for manufacturing the water diffuser 200 can be used to form a frame 470 with water diffusers 200 there on.

Frame 470 can be permanently attached to a water sports board. Frame 470 can be detachably attached to a water sports board. Frame 470 can be attached or joined to the bottom surface of a water sports board in the same manner described for the individual water diffusers 200. For example, frame 470 can be attached to a water sports board by adhesive, tape, one or more screws, one or more snap-joints, or a combination thereof. The adhesive, tape, or combination thereof is indicated by item 476 and can be similar to adhesive and tape previously described with respect to water diffuser 200. One or more screws can be inserted either through the water diffusers 200 as describe previously. Alternatively, frame 470 can include one or more screw holes 475 to insert one or more screws. Also, frame 470 can include one or more lip portions 477 that can fit into one or more slots at the bottom surface of the water sports board as previously described with respect to the water diffusers 200. The number of screw holes 475 and lip portions 477 is not particularly limited other than by the size of frame 470. In exemplary embodiments, frame 470 can include one, two, three, four, five, six, seven, eight, nine, ten, fifteen, twenty, twenty five, or thirty screw holes, lip portions, or both. In exemplary embodiments, the number of screw holes, lip portions, or both in frame 470 is one greater than the number of water diffusers on frame 470. For example, if four water diffusers are located on frame 470, then frame 470 can include five screw holes, five lip portions, or a combination of both. The screw holes, lip portions, or both can be located only in the water diffusers 200, only in frame 470, or a combination of both. The number of respective screw holes, slots, or both at the bottom surface of the water sports board can be as previously described with respect to the water diffuser 200. In exemplary embodiments, the bottom surface of the water sports board has sufficient number of screw holes, lip portions, or both to accommodate one or more arrangements for connecting the screws, lip portions, or both of frame 470, water diffuser 200, or both.

As described earlier with respect to water diffusers 200, a water diffuser system having a frame 470 with one or more water diffusers 200 can also be attached to a board prior to glassing and then forming the glassing over it. Thus, becoming an integral portion of the board.

Frame 470 can be any desired shape or design. In embodiments, frame 470 is a strip of material. Frame 470 can have a straight shape as, for example, illustrated in FIG. 4F. Frame 470 can have a curved shape as, for example, illustrated in FIG. 4G. Frame 470 can have an irregular shape. Frame 470 can have a zig-zag shape. Frame 470 can have a square-wave or quasi-square wave shape as, for example, illustrated in FIG. 4H. Frame 470 can also have a combination of any two or more of the above shapes. FIG. 4I illustrate an exemplary side view. Also, although FIGS. 4F-4H illustrate the water diffusers 200 as extending beyond the borders of frame 470, they are not required. For example, as illustrated in FIG. 4J, the water diffusers 200 can fully fit on frame 470. Frame 470 can be of any suitable thickness. Preferably frame 470 has a thickness ranging from about 0.06 inches to about 0.5 inches.

Figure 4A:
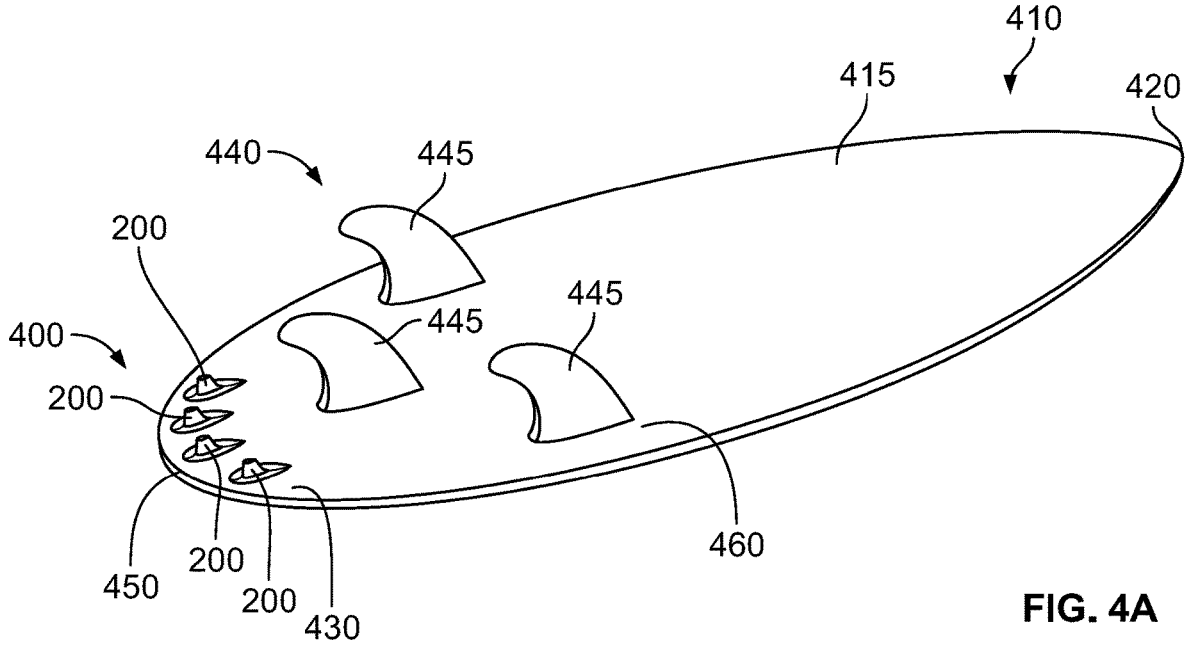
FIGS. 4A-4K illustrate exemplary implementations of a water diffuser system on a bottom surface of a water sports board.
Figure 4B:
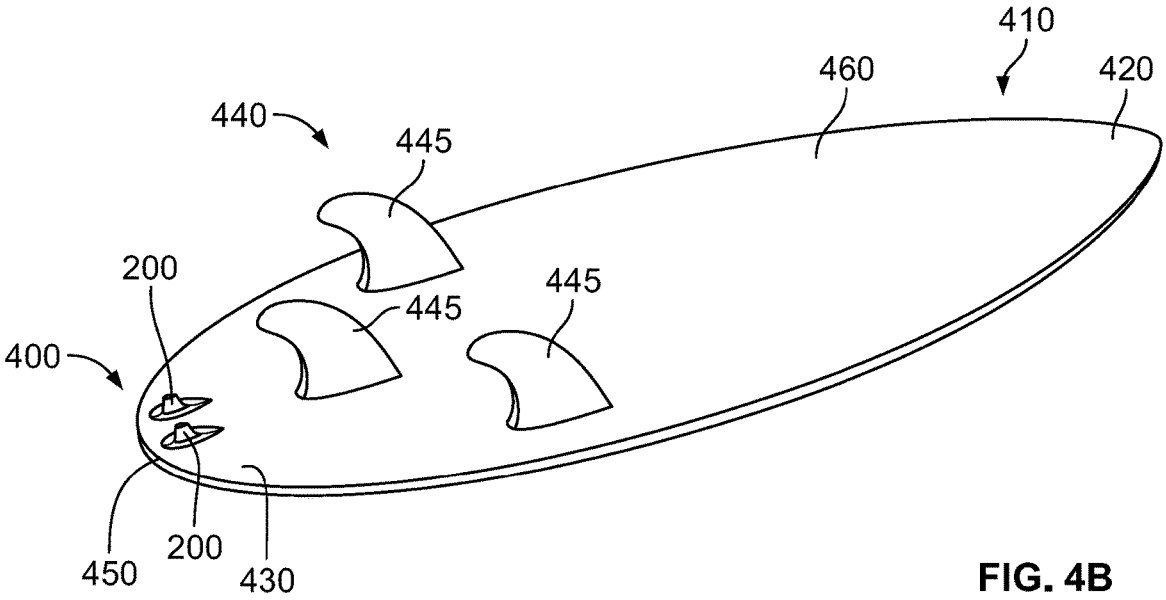
Figure 4C:
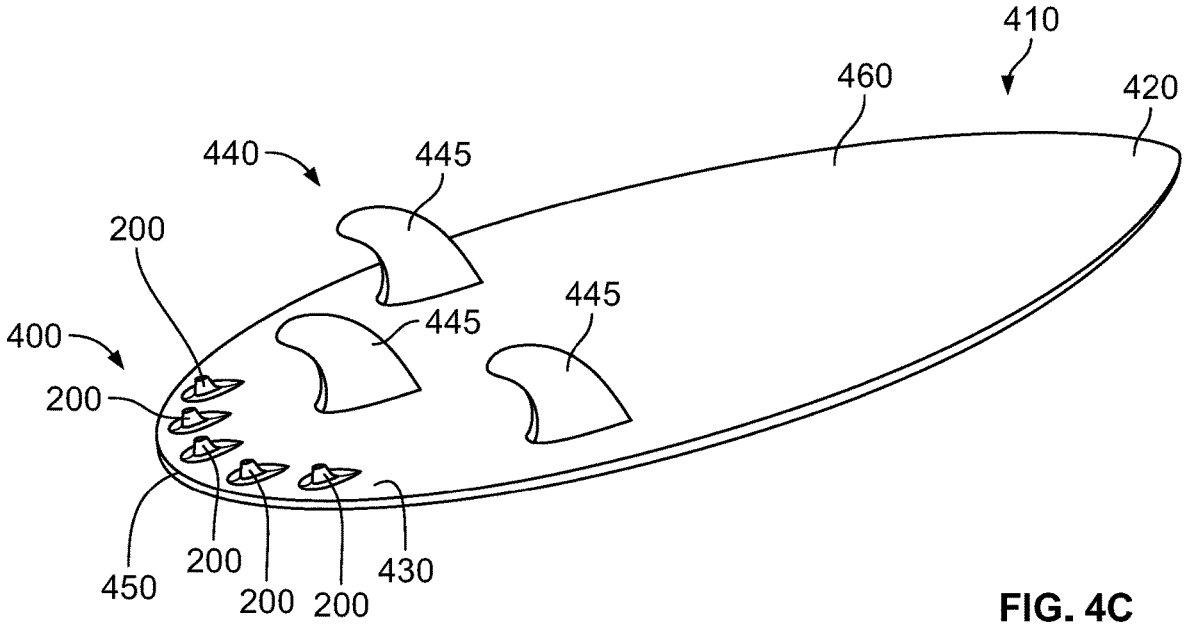
Figure 4D:
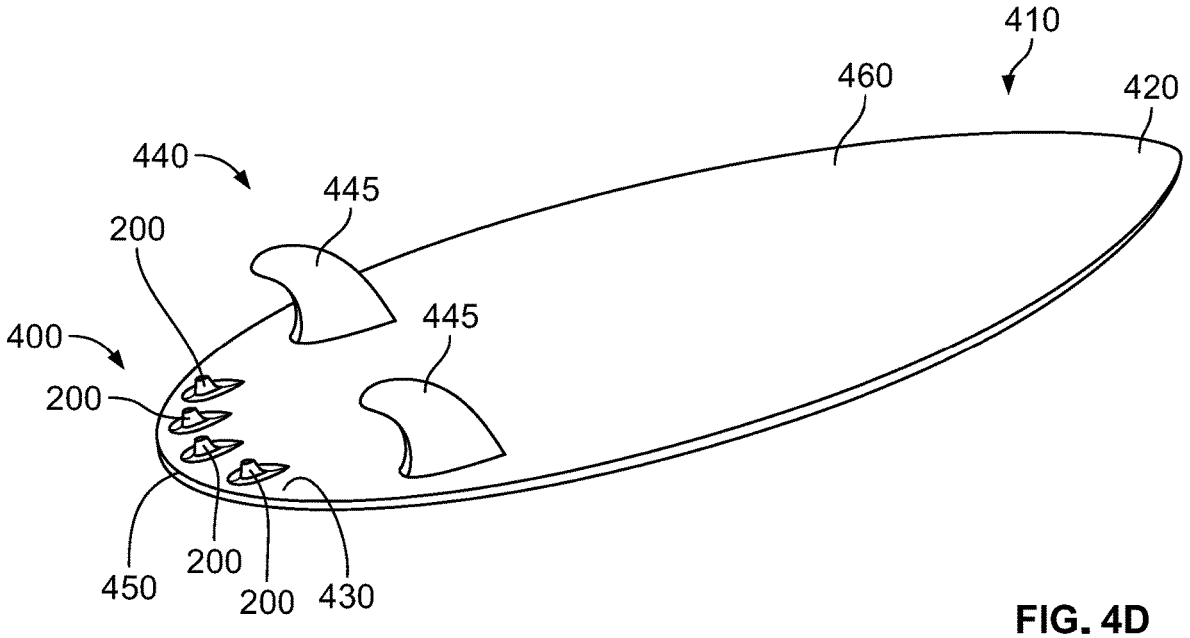
Figure 4E:
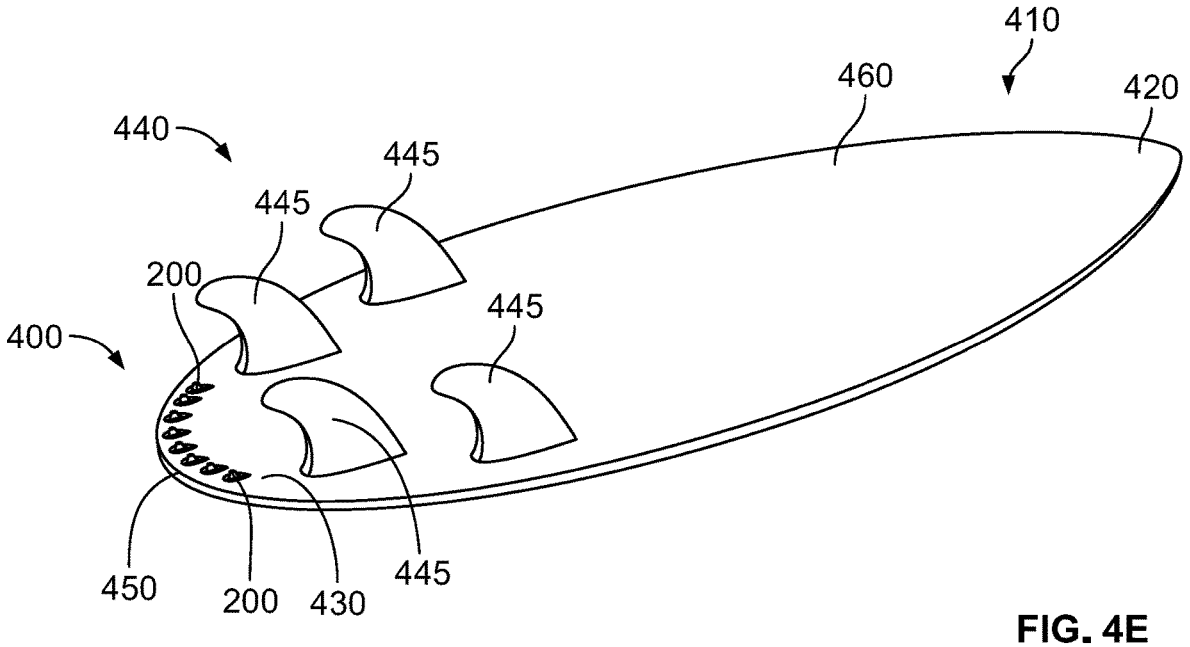
Figure 4F:
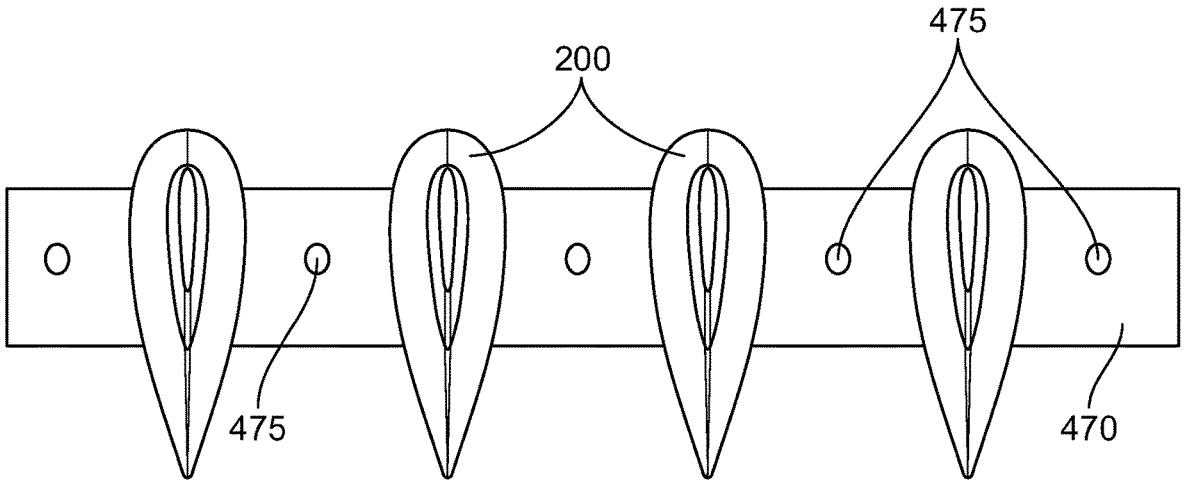
Figure 4G:
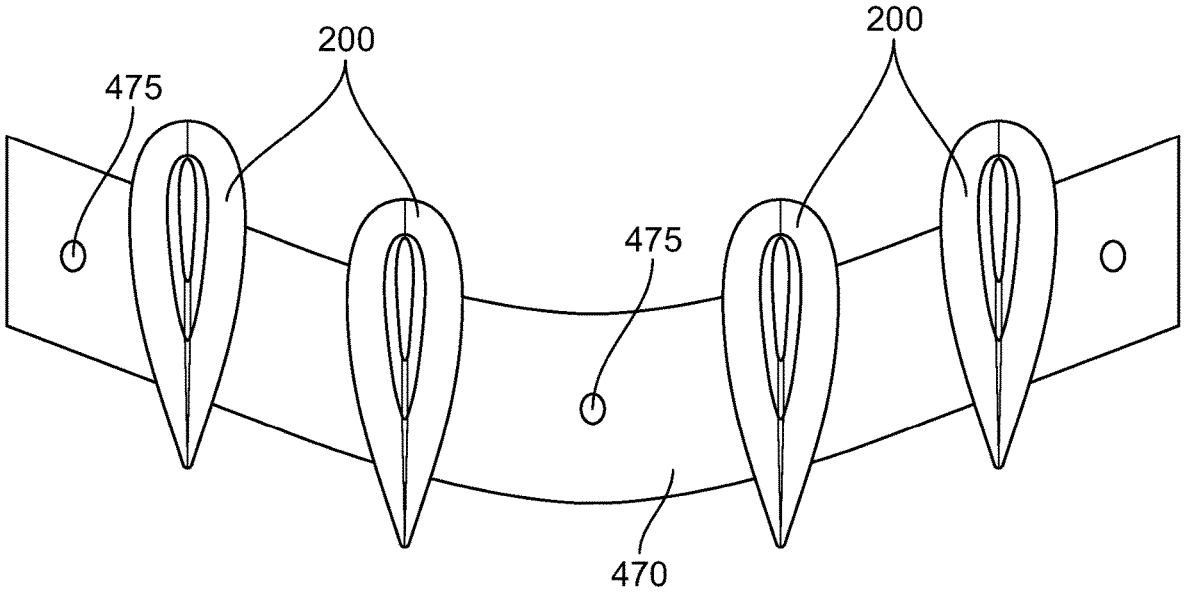
Figure 4H:
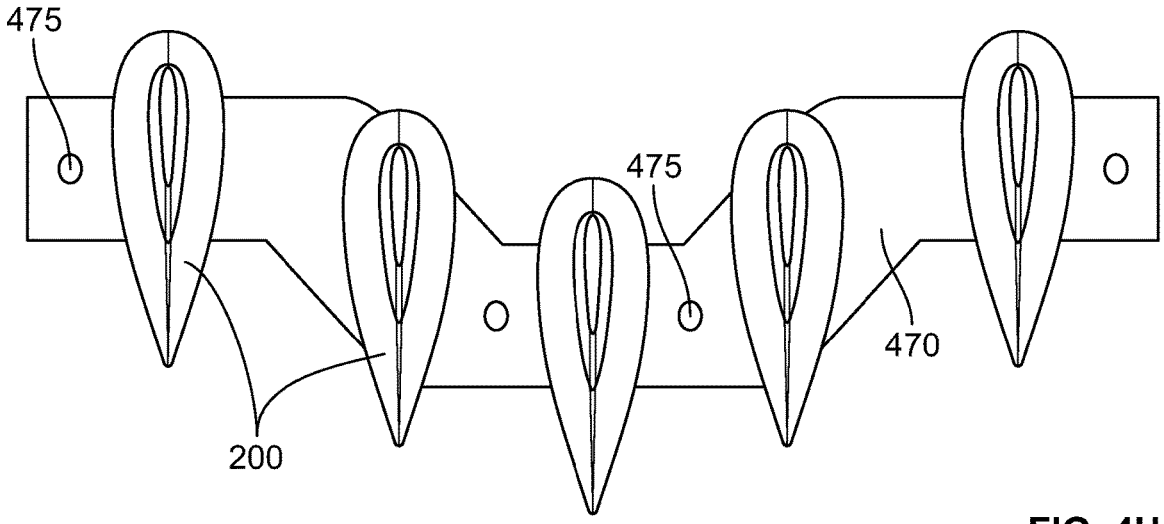
Figure 4I:
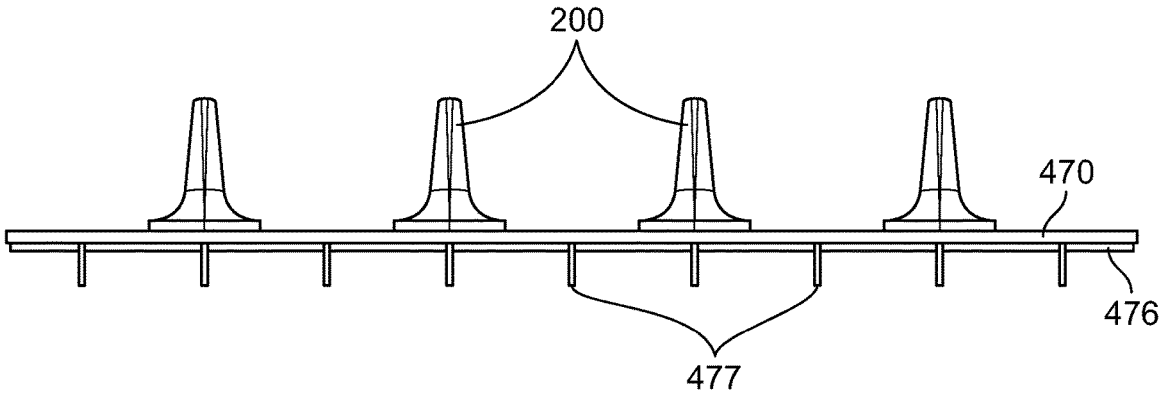
Figure 4J:
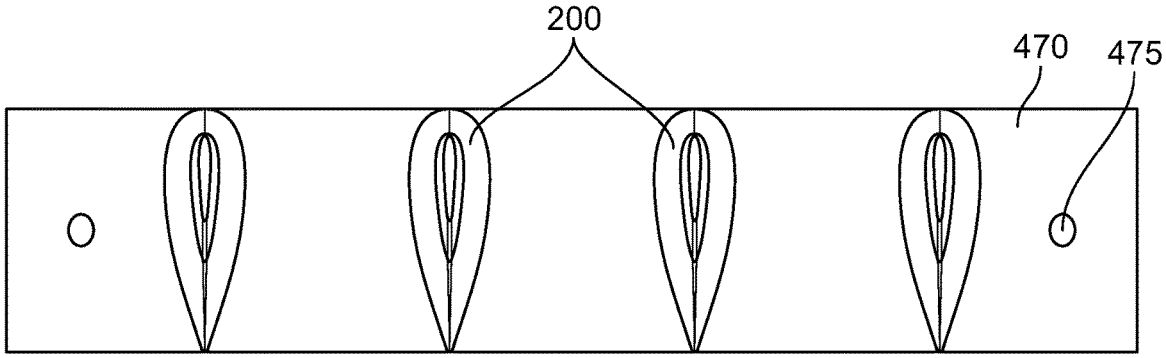
Figure 4K:
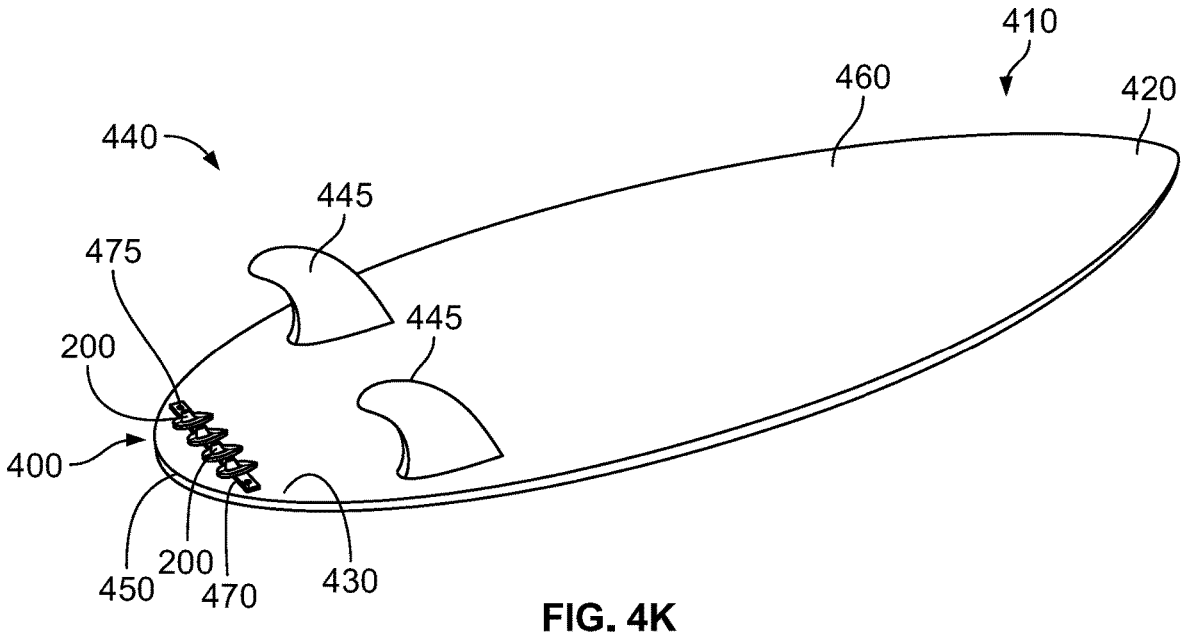

FIG. 4K illustrates an embodiment in which a water diffuser system 400 including a frame 470 is installed on a water sports board.

An example is illustrated in FIG. 4A, showing an exemplary water sports board 410, including a rigid body 415, a nose or front 420, a tail 430, a fin system 440 with fins 445, can include a water diffuser system 400 near the tail edge 450 of tail 430. As used herein, and as referenced by item 450, the term "tail edge" is used to refer to the back edge of the tail of the water sports board that defines the boundary of the bottom surface of the water sports board that is at the opposite end of the water sports board from the nose and is where the bottom surface and tail of the water sports board end. It should be noted that the water diffuser system 400 includes a number of water diffusers 200 that are positioned closer to the tail edge 450 of tail 430 than the fins 445 of fin system 440. In fact, the water diffuser system 400 as a whole is located closer to tail edge 450 of tail 430 than fin system 440. This is because, as explained further below, the water diffuser system 400 is intended to modify the turbulence and cavitation caused by the fin system 440. As such, the water diffuser system 400 must be located so that during use, the water flowing along the bottom surface 460 of board 410 from nose 420 to tail 430 comes into contact with the fin system 440 before coming into contact with water diffuser system 400.

The individual water diffusers 200 that make up the water diffuser system 400 can be spaced apart. In exemplary embodiments, the water diffusers 200 are evenly spaced so as to be equally laterally spaced from each other. Alternatively, the water diffusers 200 are not evenly spaced. Also, a combination can also be used where some water diffusers 200 may be evenly spaced, while other water diffusers 200 are not evenly spaced.

The spacing between water diffusers 200 can depend on the shape and size of the tail of the water sports board. In embodiments, the spacing between water diffusers 200 can range from about 0.75 inches to about 4 inches. For example, the spacing can be about: 0.75 inches, 0.76 inches, 0.77 inches, 0.78 inches, 0.79 inches, 0.8 inches, 0.81 inches, 0.82 inches, 0.83 inches, 0.84 inches, 0.85 inches, 0.86 inches, 0.87 inches, 0.88 inches, 0.89 inches, 0.9 inches, 0.91 inches, 0.92 inches, 0.93 inches, 0.94 inches, 0.95 inches, 0.96 inches, 0.97 inches, 0.98 inches, 0.99 inches, or 1.0 inches1.0 inches, 1.01 inches, 1.02 inches, 1.03 inches, 1.04 inches, 1.05 inches, 1.06 inches, 1.07 inches, 1.08 inches, 1.09 inches, 1.10 inches, 1.11 inches, 1.12 inches, 1.13 inches, 1.14 inches, 1.15 inches, 1.16 inches, 1.17 inches, 1.18 inches, 1.19 inches, 1.20 inches, 1.21 inches, 1.22 inches, 1.23 inches, 1.24 inches, 1.25 inches, 1.26 inches, 1.27 inches, 1.28 inches, 1.29 inches, 1.30 inches, 1.31 inches, 1.32 inches, 1.33 inches, 1.34 inches, 1.35 inches, 1.36 inches, 1.37 inches, 1.38 inches, 1.39 inches, 1.40 inches, 1.41 inches, 1.42 inches, 1.43 inches, 1.44 inches, 1.45 inches, 1.46 inches, 1.47 inches, 1.48 inches, 1.49 inches, 1.50 inches, 1.51 inches, 1.52 inches, 1.53 inches, 1.54 inches, 1.55 inches, 1.56 inches, 1.57 inches, 1.58 inches, 1.59 inches, 1.60 inches, 1.61 inches, 1.62 inches, 1.63 inches, 1.64 inches, 1.65 inches, 1.66 inches, 1.67 inches, 1.68 inches, 1.69 inches, 1.70 inches, 1.71 inches, 1.72 inches, 1.73 inches, 1.74 inches, 1.75 inches, 1.76 inches, 1.77 inches, 1.78 inches, 1.79 inches, 1.80 inches, 1.81 inches, 1.82 inches, 1.83 inches, 1.84 inches, 1.85 inches, 1.86 inches, 1.87 inches, 1.88 inches, 1.89 inches, 1.90 inches, 1.91 inches, 1.92 inches, 1.93 inches, 1.94 inches, 1.95 inches, 1.96 inches, 1.97 inches, 1.98 inches, 1.99 inches, 2.0 inches, 2.01 inches, 2.02 inches, 2.03 inches, 2.04 inches, 2.05 inches, 2.06 inches, 2.07 inches, 2.08 inches, 2.09 inches, 2.10 inches, 2.11 inches, 2.12 inches, 2.13 inches, 2.14 inches, 2.15 inches, 2.16 inches, 2.17 inches, 2.18 inches, 2.19 inches, 2.20 inches, 2.21 inches, 2.22 inches, 2.23 inches, 2.24 inches, 2.25 inches, 2.26 inches, 2.27 inches, 2.28 inches, 2.29 inches, 2.30 inches, 2.31 inches, 2.32 inches, 2.33 inches, 2.34 inches, 2.35 inches, 2.36 inches, 2.37 inches, 2.38 inches, 2.39 inches, 2.40 inches, 2.41 inches, 2.42 inches, 2.43 inches, 2.44 inches, 2.45 inches, 2.46 inches, 2.47 inches, 2.48 inches, 2.49 inches, 2.50 inches, 2.51 inches, 2.52 inches, 2.53 inches, 2.54 inches, 2.55 inches, 2.56 inches, 2.57 inches, 2.58 inches, 2.59 inches, 2.60 inches, 2.61 inches, 2.62 inches, 2.63 inches, 2.64 inches, 2.65 inches, 2.66 inches, 2.67 inches, 2.68 inches, 2.69 inches, 2.70 inches, 2.71 inches, 2.72 inches, 2.73 inches, 2.74 inches, 2.75 inches, 2.76 inches, 2.77 inches, 2.78 inches, 2.79 inches, 2.80 inches, 2.81 inches, 2.82 inches, 2.83 inches, 2.84 inches, 2.85 inches, 2.86 inches, 2.87 inches, 2.88 inches, 2.89 inches, 2.90 inches, 2.91 inches, 2.92 inches, 2.93 inches, 2.94 inches, 2.95 inches, 2.96 inches, 2.97 inches, 2.98 inches, 2.99 inches, 3.0 inches, 3.01 inches, 3.02 inches, 3.03 inches, 3.04 inches, 3.05 inches, 3.06 inches, 3.07 inches, 3.08 inches, 3.09 inches, 3.10 inches, 3.11 inches, 3.12 inches, 3.13 inches, 3.14 inches, 3.15 inches, 3.16 inches, 3.17 inches, 3.18 inches, 3.19 inches, 3.20 inches, 3.21 inches, 3.22 inches, 3.23 inches, 3.24 inches, 3.25 inches, 3.26 inches, 3.27 inches, 3.28 inches, 3.29 inches, 3.30 inches, 3.31 inches, 3.32 inches, 3.33 inches, 3.34 inches, 3.35 inches, 3.36 inches, 3.37 inches, 3.38 inches, 3.39 inches, 3.40 inches, 3.41 inches, 3.42 inches, 3.43 inches, 3.44 inches, 3.45 inches, 3.46 inches, 3.47 inches, 3.48 inches, 3.49 inches, 3.50 inches, 3.51 inches, 3.52 inches, 3.53 inches, 3.54 inches, 3.55 inches, 3.56 inches, 3.57 inches, 3.58 inches, 3.59 inches, 3.60 inches, 3.61 inches, 3.62 inches, 3.63 inches, 3.64 inches, 3.65 inches, 3.66 inches, 3.67 inches, 3.68 inches, 3.69 inches, 3.70 inches, 3.71 inches, 3.72 inches, 3.73 inches, 3.74 inches, 3.75 inches, 3.76 inches, 3.77 inches, 3.78 inches, 3.79 inches, 3.80 inches, 3.81 inches, 3.82 inches, 3.83 inches, 3.84 inches, 3.85 inches, 3.86 inches, 3.87 inches, 3.88 inches, 3.89 inches, 3.90 inches, 3.91 inches, 3.92 inches, 3.93 inches, 3.94 inches, 3.95 inches, 3.96 inches, 3.97 inches, 3.98 inches, 3.99 inches, or 4.0 inches.

The water diffusers 200 can be spaced so that the water diffuser system 400 is are located closer to the tail edge than fin system 440 and in such a way that the water diffuser system 400 comes into contact the turbulence and cavitation that can be caused by the fins 445 of fin system 440.

Figure 6A:
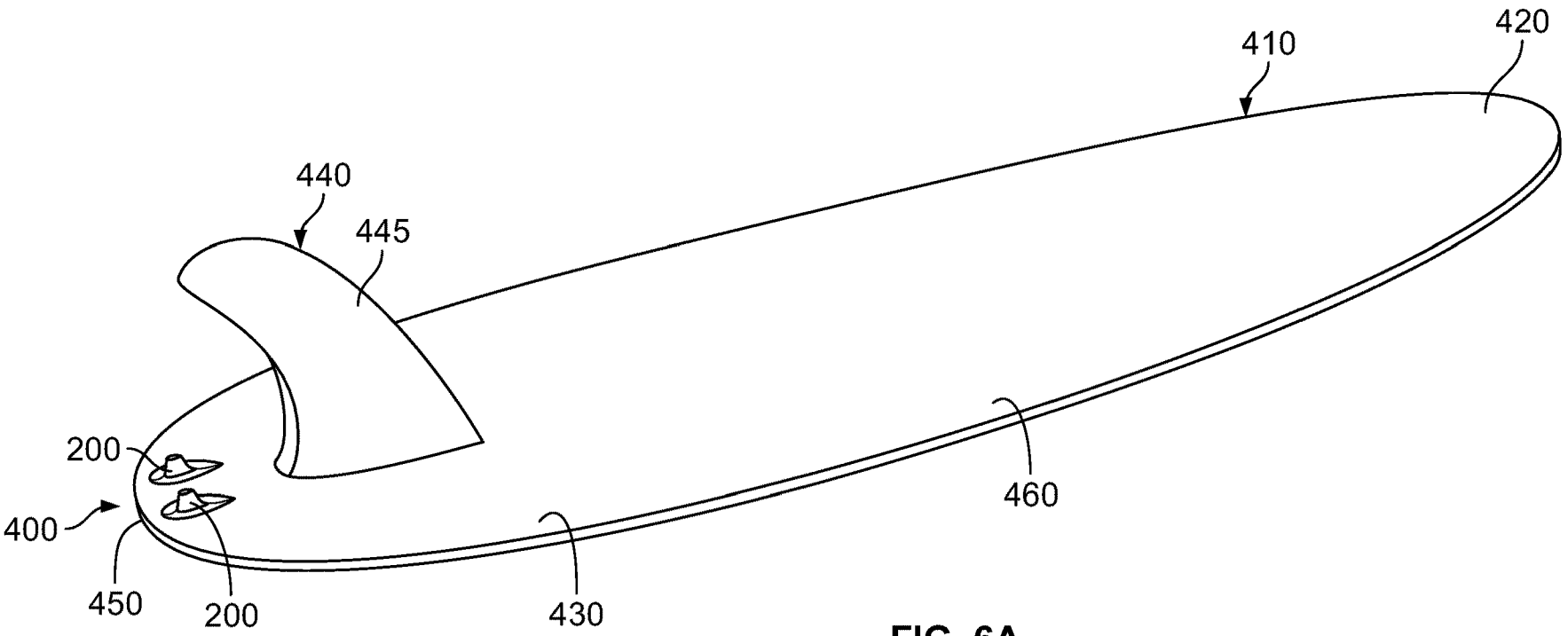
FIGS. 6A-6B illustrate exemplary arrangements of water diffuser systems on the bottom surface of different water sports boards.
Figure 6B:
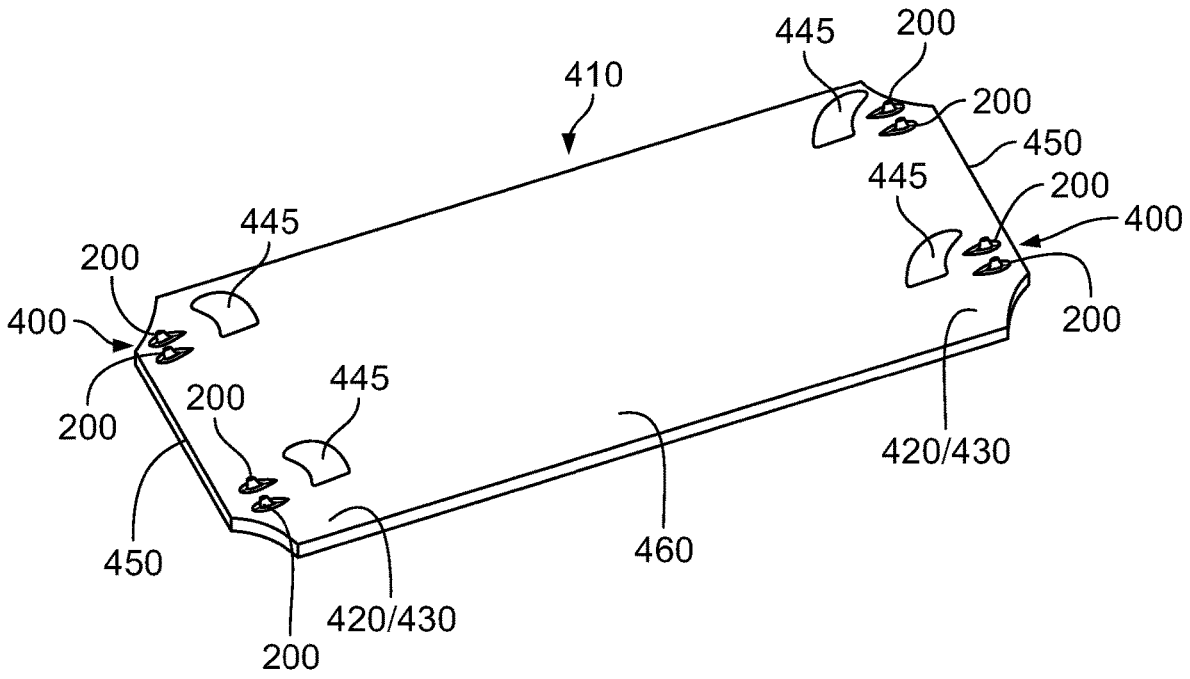

In the illustrated embodiment of FIG. 4A, the water diffuser system 400 includes four water diffusers 200, evenly spaced and located on bottom surface 460 of water sports board 410, near tail edge 450 of tail 430, behind a three-fin, a.k.a. thruster, fin system 440. The water sports board 410 of FIG. 4A can be a surfboard. The water sports board 410 of FIG. 4A is illustrated as a typical shortboard shape, however, it should be understood that this is only illustrative and that water sports board 410 could also be a longboard, paddle boards, a funboard, a gun, a windsurfing board, a wakeboard, a wakesurf board, or a kiteboard. Illustrative examples of a longboard and kiteboard are illustrated in FIGS. 6A-6B. The arrangement of FIG. 4A is simply illustrative and should not be viewed as limiting.

Figure 5A:
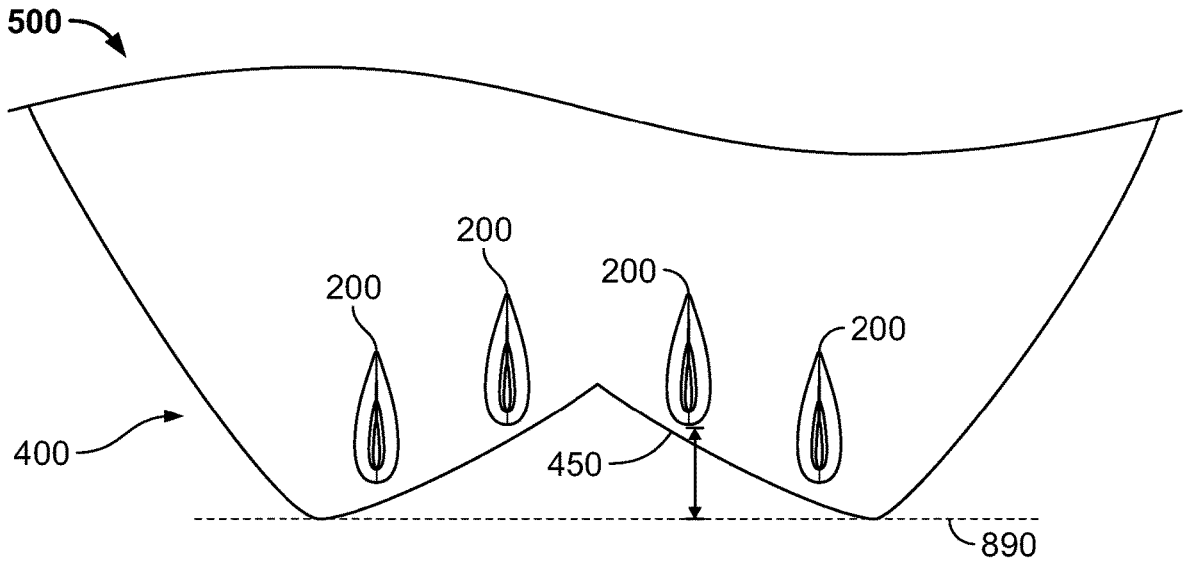
FIG. 5A-5C illustrate exemplary arrangements of water diffusers on the bottom surface of different water sports board tail designs.
Figure 5B:
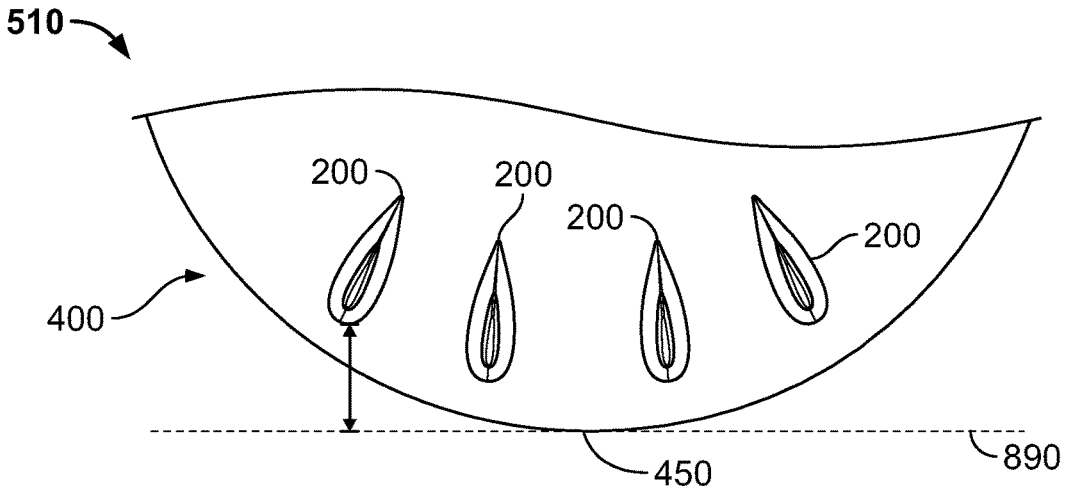
Figure 5C:
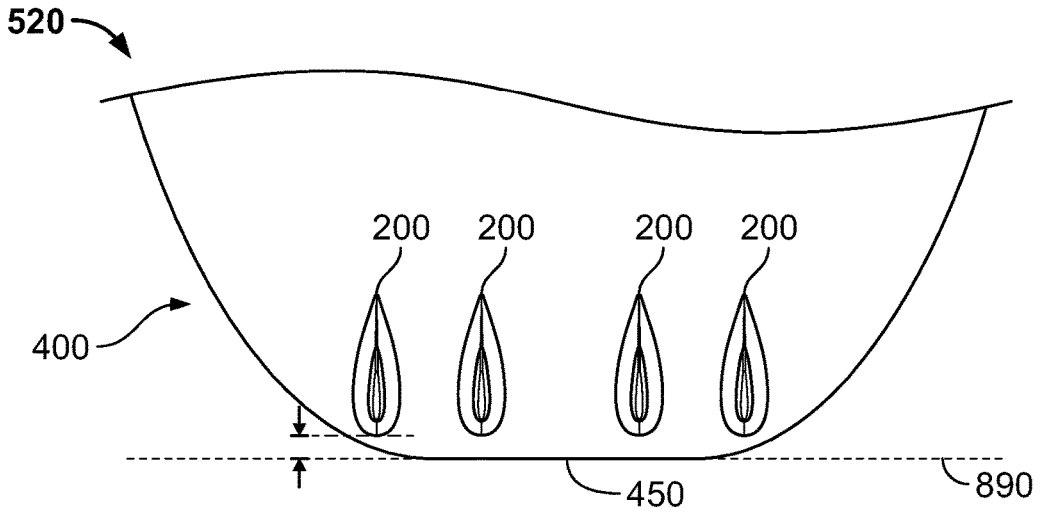

The water diffusers 200 of water diffuser system 400 can be spaced from tail edge 450 such as to be located at a distance from tail edge 450 that ranges from about 0.06 inches to about 4 inches. For purposes of this description, spacing between water diffusers 200 of water diffuser system 400 and tail edge 450 refers to the distance between the tail edge 450 and water diffuser 200 that is defined by the shortest linear distance from a plane 890 that is tangential to the outer point of tail edge 450 to the outer point of back end 218, for example the midpoint of round end 208, of the water diffuser 200. For illustrative purposes the tangential plane 890 is shown in FIGS. 5A-5C. In the exemplary embodiment of FIG. 4A, the distance from tail edge 450 to water diffusers 200 is about 0.06 inches to about 0.75 inches. In other exemplary embodiments, the distance from tail edge 450 to each of the water diffusers 200 of water diffuser system 400 can be about: 0.06 inches, 0.07 inches, 0.08 inches, 0.09 inches, 0.10 inches, 0.15 inches, 0.20 inches, 0.25 inches, 0.30 inches, 0.35 inches, 0.40 inches, 0.45 inches, 0.50 inches, 0.55 inches, 0.60 inches, 0.65 inches, 0.70 inches, 0.75 inches, 0.80 inches, 0.85 inches, 0.90 inches, 0.95 inches, 1.10 inches, 1.15 inches, 1.20 inches, 1.25 inches, 1.30 inches, 1.35 inches, 1.40 inches, 1.45 inches, 1.50 inches, 1.55 inches, 1.60 inches, 1.65 inches, 1.70 inches, 1.75 inches, 1.80 inches, 1.85 inches, 1.90 inches, 1.95 inches, 2.10 inches, 2.15 inches, 2.20 inches, 2.25 inches, 2.30 inches, 2.35 inches, 2.40 inches, 2.45 inches, 2.50 inches, 2.55 inches, 2.60 inches, 2.65 inches, 2.70 inches, 2.75 inches, 2.80 inches, 2.85 inches, 2.90 inches, 2.95 inches, 3.10 inches, 3.15 inches, 3.20 inches, 3.25 inches, 3.30 inches, 3.35 inches, 3.40 inches, 3.45 inches, 3.50 inches, 3.55 inches, 3.60 inches, 3.65 inches, 3.70 inches, 3.75 inches, 3.80 inches, 3.85 inches, 3.90 inches, 3.95 inches, or 4.0 inches.

The distance between tail edge 450 and each water diffuser 200 of water diffuser system 400 can be the same or different. For example, a water diffuser system 400 can include two or more water diffusers 200 each of which is located at the same distance from tail edge 450. A water diffuser system 400 can include two or more water diffusers 200 each of which is located a different distance from tail edge 450. In some embodiments, a water diffuser system 400 can include two or more water diffusers 200 some of which are located at a first distance from tail edge 450, while others are located a second distance from tail edge 450, wherein the first distance and second distance are different. Any combination of various arrangements using different distances for one or more water diffusers of a water diffuser set can also be implemented.

The distance between the water diffusers 200 of water diffuser system 400 and the fins 445 of fin system 440 is not particularly limited other than by the size of the water sports board.

The water diffusers 200 of water diffuser system 400 can be arranged to promote smooth flow at the tail edge 450. The water diffusers 200 can be installed so as to be oriented parallel to the central axis of the water sports board. In other words, the water diffusers 200 can be arranged such that a horizontal line dissecting front end 219 in equal halves is parallel to the central axis of the water sports board. For purposes of this discussion the "central axis of the water sports board" refers to the longitudinal rectilinear center axis extending from nose to tail of a water sports board, and which axis is equidistant from both rails of the water sports board as described by item 801 in conjunction with FIG. 8. Water diffusers 200 can also be arranged to be toe-in with respect to the central axis of the water sports board. Embodiments may include some water diffusers 200 that are parallel to the central axis of the water sports board and some water diffusers 200 that are arranged toe-in. For purposes of this disclosure, "toe-in" means that the water diffuser can be angled with respect to the central axis of the water sports board so that its back end 218 is angled away from the central axis of the water sports board while the front end 219 is angled toward the central axis of the water sports board. The angling of toe-in arranged water diffusers 200 can be set as desired. In an illustrative example, FIG. 5B illustrates four water diffusers 200, the middle two water diffusers being parallel to the central axis, while the outer two water diffusers are arranged toe-in with respect to the central axis of the water sports board. In exemplary embodiments, the toe-in angle is in the range of from about 5° to about 15°, for example about: 5°, 6°, 7°, 8°, 9°, 10° 11, 12, 13, 14, or 15°.

Additional, non-limiting exemplary arrangements are illustrated in FIGS. 4B-4E. FIG. 4B illustrates a similar water sports board as shown in FIG. 4A, but with only two water diffusers 200 installed on the bottom surface 460 of the water sports board. FIG. 4C also illustrates a similar water sports board as shown in FIG. 4A, but with five water diffusers 200 installed on the bottom surface 460 of the water sports board. FIG. 4D illustrates a water sports board with a twin-fin, fin system and four water diffusers 200. FIG. 4E illustrates a water sports board with a Quad, or four-fin, fin system, and six water diffusers 200. The illustrations of FIGS. 4A-4E demonstrate that the number of water diffusers 200 in water diffuser 400 can be altered independent of the fin system used in the water sports board. Also, FIGS. 4A-4E illustrate that the water diffuser system 400 including water diffusers 200 can be implemented independent of the type of fin system used in the water sports board. These examples are only illustrative and should not be viewed as limiting.

Also, illustrative examples of the water diffusers 200 and water diffuser system 400 installed on different types of water sports boards are provided in FIGS. 6A-6B. For ease of reference, the same reference numerals of FIGS. 4A-4E are used. FIG. 6A illustrates a water sports board that mimics the shape of a typical longboard, funboard, and paddle board. The water sports board 410 can include a single fin system having one large fin 445. Different from shortboards, guns, longboards, funboards, and paddle boards typically have much greater overall board volume. Also, longboards and funboards are typically longer and have a more rounded nose 420. Paddle boards can have a rounded or pointed nose. The water diffusers 200 of water diffuser system 400 can likewise be implemented in these types of boards. In exemplary embodiment of FIG. 6A, two water diffusers 200 are provided near tail edge 450. Although not illustrated, longboards, funboards, and paddle boards can also be equipped with different fin systems. Likewise, it is within the scope of this disclosure that water diffuser systems 400 having fewer or more water diffusers 200 can be installed. The number of water diffusers 200 that can be installed in longboards, funboards, or paddle boards is the same as previously discussed with respect to FIGS. 4A-4E as well as generally discussed throughout the general description.

FIG. 6B illustrates another exemplary embodiment of the implementation of the water diffuser system 400. FIG. 6B illustrates a water sports board that mimics the shape of a common kiteboard. As illustrated, kiteboards can include more squared ends and can be designed to have two mirroring fin systems. This should not be viewed as limiting, as some kiteboards can include fins only at one end. The use of a dual fin system in a kiteboard can be useful to allow better riding in both directions. This means that the nose 420 and tail 430 of a kiteboard can be designed to have a similar shape and the nomenclature for these two sections depends on the direction of travel during use. Accordingly, for illustrative purposes only, an exemplary kiteboard is shown with both ends including a fin system each of which can be considered a tail 430, with a tail edge 450. As illustrated, although two fin systems are used, with fins 445 at each end of the kiteboard, a water diffuser system 400 including two or more water diffusers 200 can also be provided at each end of the kiteboard. The number of water diffusers 200 and their arrangement is the same as previously described earlier. The illustration of FIG. 6B showing four water diffusers 200 at each end of kiteboard 410 is only illustrative. Fewer and more water diffusers 200 can equally be installed as discussed earlier with respect to FIGS. 4A-4E and as described more generally throughout the description.

The water diffuser system 400 with water diffusers 200 can also be implemented independent of the shape of the tail of a water sports board. There are numerous tail designs that are used in water sports boards. The design of the tail of a water sports board does not limit the implementation of the water diffuser system 400 with water diffusers 200. FIGS. 5A-5C illustrate some of the more common tail designs. The illustrated designs are not meant to be an exhaustive list and are only illustrative.

FIG. 5A illustrate what is known as a swallow tail design. FIG. 5B illustrates a round or pin tail design. FIG. 5C illustrates a squash tail design. Additional tail designs are well known in the art and will not be listed here, still they should be considered to be included within the scope of the invention.

FIGS. 5A-5C illustrate the implementation of water diffuser system 400 with water diffusers 200 on different tail designs. In embodiments, the distance between the water diffusers 200 and the tail edge 450 can be maintained the same across all water diffusers 200 by arranging the water diffusers 200 in accordance with the contour of tail edge 450.

For example, FIG. 5A illustrates water diffusers 200 arranged along the tail edge 450 of a swallow tail 500. To maintain the distance between water diffusers 200 and tail edge 450, the water diffusers 200 are not arranged in a straight line. Instead, the water diffusers 200 are arranged to follow the contour of the tail edge 450. As such, the two middle water diffusers 200 are set up inward, i.e. closer to the nose of the water sports board, compared to the outer two water diffusers 200.

FIG. 5B illustrates an example of how the water diffuser system 400 having water diffusers 200 can be installed on a round tail shaped tail edge 450. Round tail 510 tapers at the sides, thus, if a consistent distance is desired to be maintained between the water diffusers 200 and tail edge 450, then the two outer water diffusers 200 must be installed inward, i.e. closer to the nose of the water sports board, than the two inner water diffusers 200.

Finally, FIG. 5C illustrates an example of how the water diffuser system 400 having water diffusers 200 can be installed on a squash tail 520. As illustrated, a squash tail has a generally even tail edge 450. As such, if the same distance between tail edge 450 and the water diffusers 200 is desired, then the water diffusers 200 can be arranged in parallel following in a straight line.

The illustrations of FIGS. 5A-5C are simply illustrative examples. Additional arrangements can be implemented as desired.

Figure 7A:
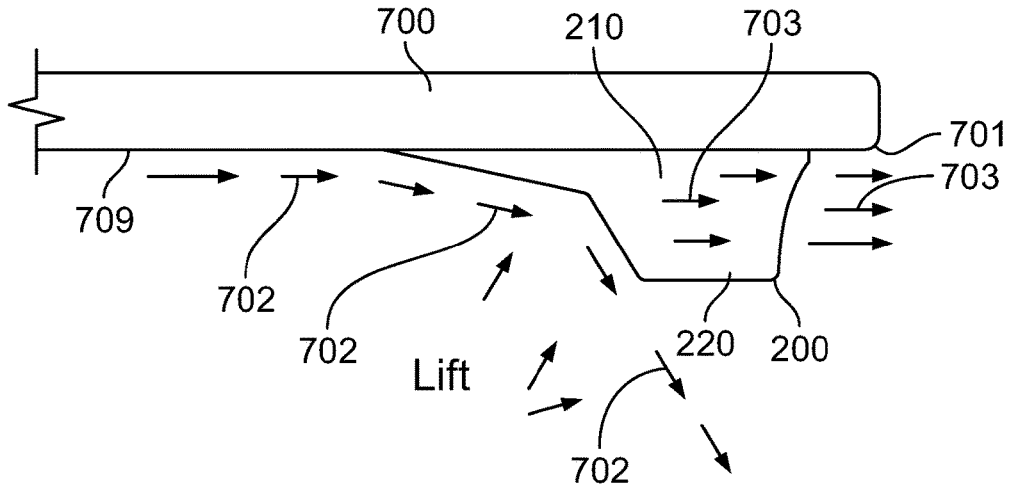
FIG. 7A-7C are diagrams illustrating the effects of embodiments of the water diffusers and water diffuser systems in accordance with the present invention.
Figure 7B:
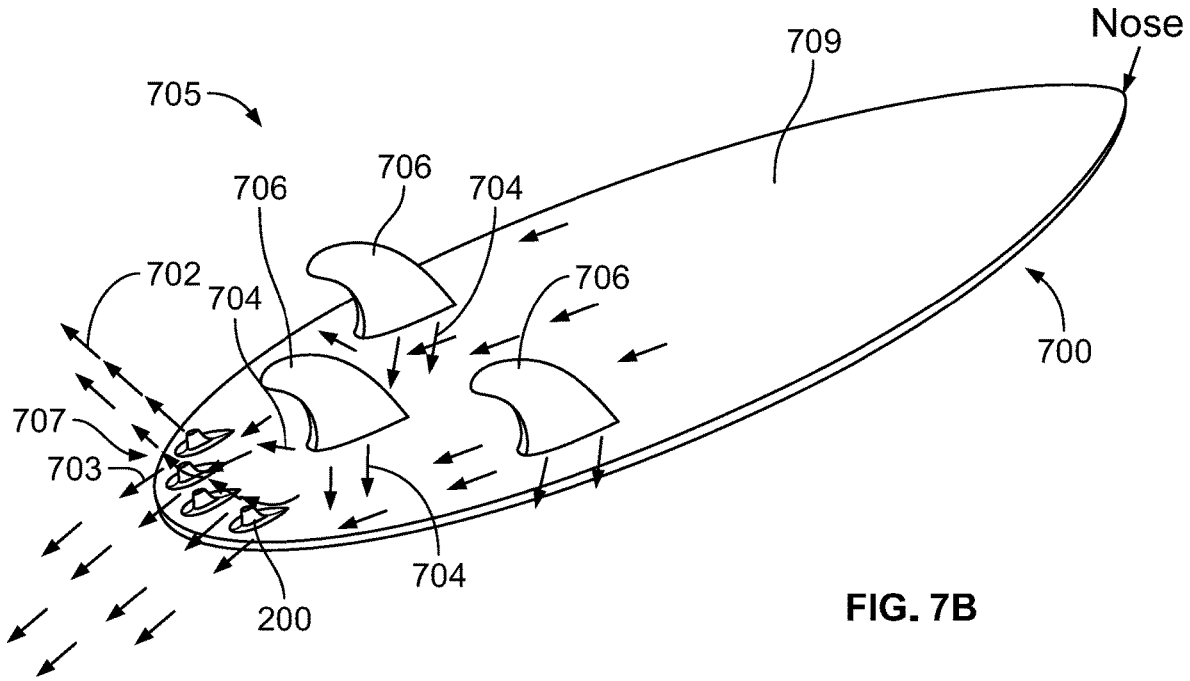
Figure 7C:
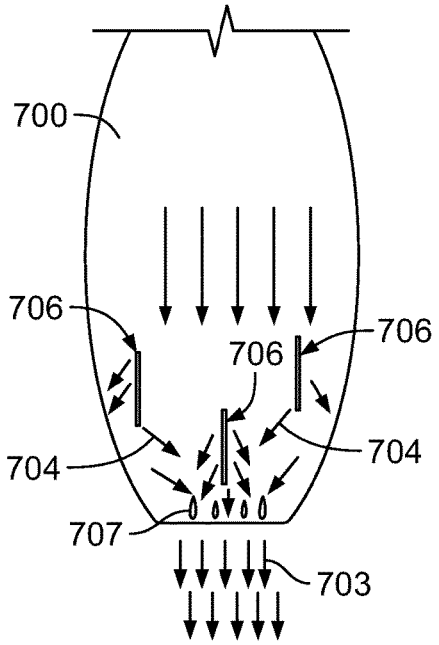
Figure 8:
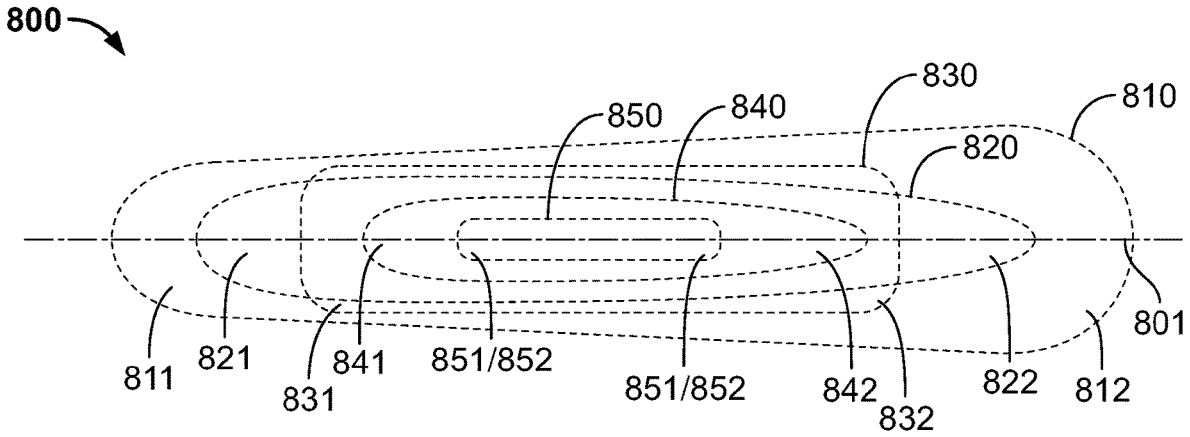
FIG. 8 (Prior Art)
FIG. 8 is a general top-down diagrammatic view illustrating overlapping outlines of exemplary types of water sports boards as generally known in the art.
Figure 9A:
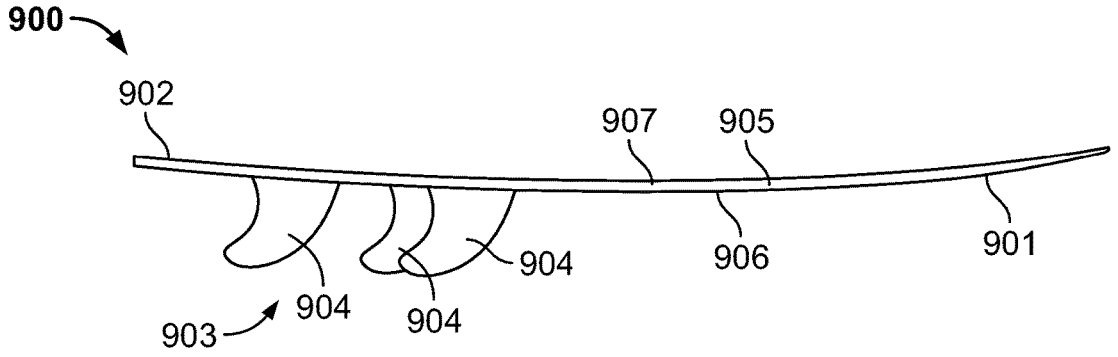
FIG. 9A (Prior Art)
FIGS. 9A-9B illustrate generic diagrams of an exemplary water sports board as generally known in the art.
Figure 9B:
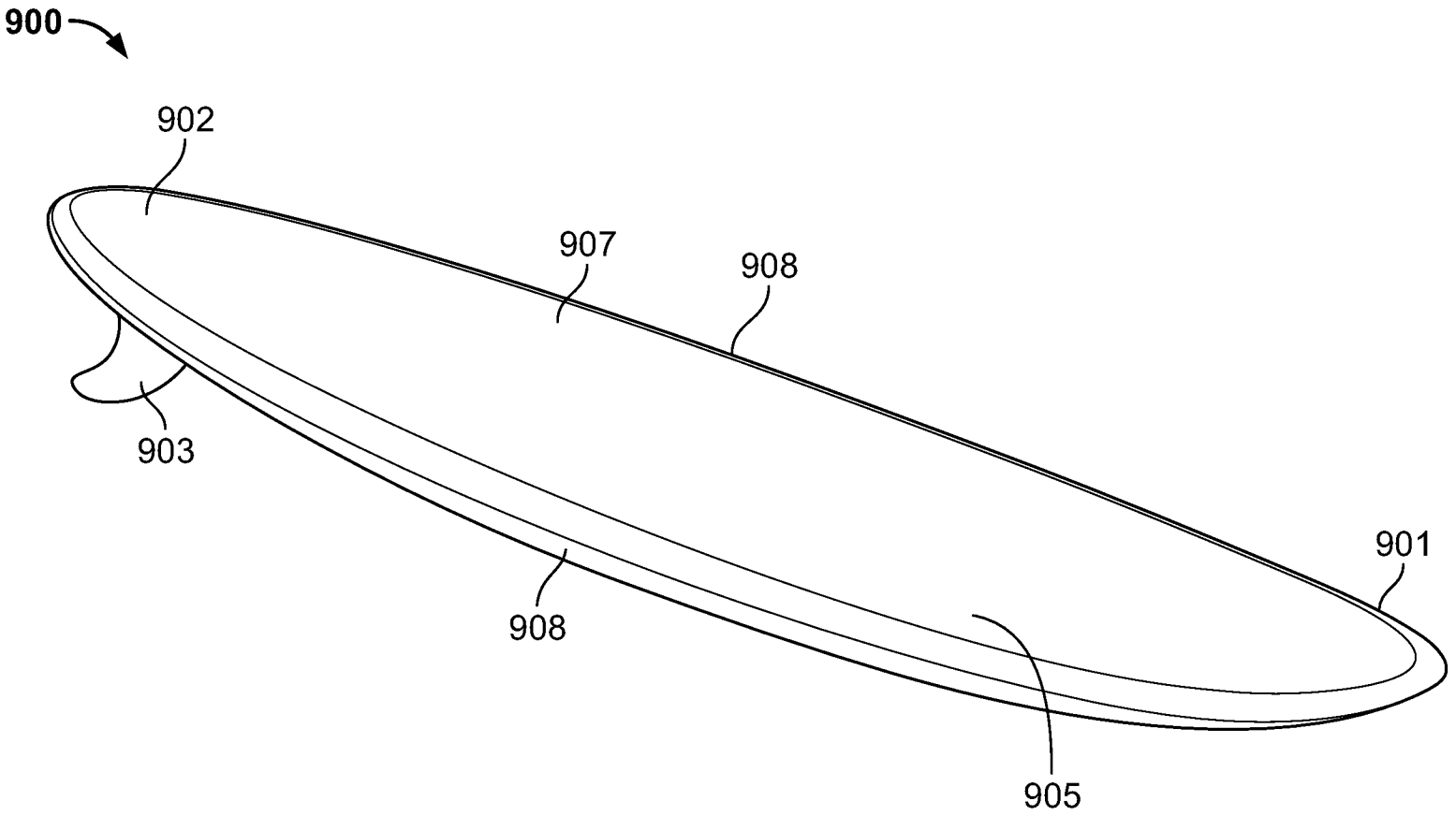
FIG. 9B (Prior Art)

The above described unique shape of water diffuser 200 implemented in a water diffuser system as described provides advantages when installed on a water sports board. The above design and configuration can maximize lift, funneling, and speed. In particular, as illustrated in FIGS. 7A-7C, the water diffuser as described herein can provide an effective remedy to instability by modulating turbulence and cavitation caused by a fin system discussed in conjunction with FIGS. 1A-1B. FIG. 7A illustrates a side view of a water diffuser 200 positioned near the edge 701 of the tail of a water sports board 700. As illustrated in FIG. 7A-7B, the overall concave contour of front edge 230 provides a ramp-like shape. This allows the flow of water, illustrated with arrows 702, that comes into contact with water diffuser 200 to flow along vertical member 220 and thus provide lift even at low speeds. As the turbulent flow 704 of water comes into contact with the water diffuser 200, it becomes smoother and more laminar flow. For example, in the illustrated design, the shape of base 210, that widens from front end 219 to back end 218, and hydrofoil shape of vertical member 230 induce smoother or more laminar flow 703 of water along the sides of water diffuser 200. The smoother or more laminar flow 703 continues past the water diffuser 200.

As water diffuser 200 glides through the turbulence 704 induced by the fin system 705, the water diffuser is able to modulate at least some of the turbulence into a smoother or more laminar flow 703 and to break-up any air bubbles that come in contact with it. As the water comes into contact with the fin system 705 of the water sports board 700, the fins 706 create a wake of cavitated turbulent liquid 704 full of air pockets and bubbles. Bubbles and air pockets at the tail end of the water sports board are the causes for the feeling of instability and loss of traction which results in loss of speed and potentially cause a surfer to fall off the board. The water diffusers 200 can slice the air bubbles thus eliminating or reducing the air pockets as they exit the tail end of the water sports board during use. In so doing, water diffuser 200 can reduce cavitation. This in turn makes for a more stable and smoother ride.

By arranging one or more water diffusers 200 of a water diffuser system 707 as described above, i.e. by locating or positioning the water diffuser system 707 near the tail edge 701 of the bottom surface 709 of a water sports board 700 as illustrated in FIGS. 7A-7C, the water diffusers 200 can dampen or reduce the turbulence and cavitation caused by the fin system 705 located in front of the water diffuser system 707. Thus, it is possible to install or locate a one or more water diffusers 200 of a water diffuser system 707 to a bottom surface 709 of a water sports board 700 at a location between a fin system 705 and a tail edge 701 of the water sports board 700 such that the water diffuser system 707 is able to modulate the cavitation and turbulence caused by the fin system 705. By locating the water diffuser system near the edge 701 of the tail of the water sports board 700 as described above, the water diffuser system allows maximum water flow along the bottom surface of the water sports board without excessive resistance. Also, due to the particular location of the water diffuser system, after the water passes by the water diffuser system, there is insufficient time for any turbulence to further interact with the bottom surface of the water sports board.

Accordingly, the water diffuser system as described herein, located at the described position, provides the advantage of reducing or modulating the turbulence and cavitation that is present at the bottom surface of the tail edge 701 of the water sports board 700. Resulting from these effects, is a smoother water flow 703 at the tail edge of the water sports board 700 which translates in increased stability. Also, because the water diffusers can also provide lift, the water diffuser system as arranged can increase lift at the tail end and thus improve overall speed of the water sports board. Accordingly, a water sports board with a water diffuser system having one or more water diffusers as described can exhibit improved stability and performance.

As discussed earlier, the water diffusers 200 can be installed as desired to form a water diffuser system 400 for a particular water sports board. In exemplary embodiments, a user of a water sports board can install one or more water diffusers 200 on an existing water sports board by any attaching means previously described. In so doing, the user can obtain a water sports board having a water diffuser system 400 with one or more water diffusers 200. Also, a water diffuser system 400 including a frame 470 with two or more water diffusers 200 can be installed on a water sports board as described previously to achieve a water sports board with a water diffuser system 400 and two or more water diffusers 200. As discussed earlier, the attaching means for each water diffuser 200 or for frame 470 can be permanent attachments or releasable attachments. Alternatively, a user can obtain a water sports board in which one or more water diffusers 200 have already been installed or where one or more water diffusers 200 have been integrally formed as described earlier. In an exemplary embodiment, a user can attach one or more water diffusers 200, for example four water diffusers 200, or a water diffuser system 400 having a frame 470 with two or more water diffusers 200, for example, four water diffusers 200, using an epoxy adhesive to the bottom surface of a water sports board. The one or more water diffusers 200, or frame 470, can be arranged such that the water diffusers 200 are proximate to the tail edge of the water sports board. Once the water diffusers 200 have been installed, either directly or by attaching frame 470, the user can use the improved water sports board as generally intended.

In an exemplary embodiment, the water diffusers can be installed on a surfboard, and the size of the water diffusers 200 can be selected based on the size of the waves for which the surfboard is intended. For example, for riding 1 to 4 foot waves, the water diffusers 200 can be selected to have a base length of about 1.03 inches, a vertical member that is about 0.31 inches in length, and an overall height of about 0.38 inches. For riding 4 to 10 foot waves, the water diffusers 200 can be selected to have a base length of about 1.38 inches, a vertical member that is about 0.43 inches, and an overall height of about 0.5 inches. For riding 10 foot or larger waves, the water diffusers 200 can be selected to have a base length of about 2.17 inches, a vertical member that is about 0.68 inches, and an overall height that is about 0.75 inches. These are just exemplary. As discussed earlier, considerations other than wave size can also be taken into account when selecting the size of the water diffusers.

For example, if the water sports board is a surfboard, a user can install one or more water diffusers 200 near the tail edge as described earlier with respect to other types of water sports board. The user can then use the surfboard to surf waves by paddling while kneeling or lying down over the deck and then jumping into a standing position when catching and riding a wave. If the water sports board is a paddle board, a user can install one or more water diffusers 200 near the tail edge as described earlier with respect to other types of water sports board. The user can then stand on the board and use a paddle to propel the board forward. The user can simply ride the paddle board on calm waters or to catch and ride waves. If the water sports board is a windsurfing board, a user can install one or more water diffusers 200 near the tail edge as described earlier with respect to other types of water sports board. The user can then stand on the deck and hold the sail to harness the wind power to propel the board forward. Windsurfing boards can be used to ride waves and over flat water. If the water sports board is a wakesurf board, a user can install one or more water diffusers 200 near the tail edge as described earlier with respect to other types of water sports board. The user can then use the wakesurf board as intended by initially being towed by a watercraft or other vehicle into the watercraft's wake and then surf the wakesurf board on the wake caused by watercraft or other vehicle without being towed by a rope. If the water sports board is a wakeboard, a user can install one or more water diffusers 200 near the tail edge as described earlier with respect to other types of water sports board. The user can then use the wakeboard as intended while being towed by a watercraft or other vehicle while surfing the wakeboard on the wake caused by the towing watercraft or other vehicle. If the water sports board is a kiteboard, a user can install one or more water diffusers 200 at either or both ends of the board, and then ride the board while standing and being towed by a kite attached to a harness worn by the user. During use, the kiteboard can be used to glide over a water surface, ride waves, and do air jumps.

Accordingly, the addition of a water diffuser system having one or more water diffusers would not alter the typical use of a water sports board. The water diffuser system with the one or more water diffusers can be used to improve the performance of the water sports board in its typical use by improving stability and lift through modulation of the turbulence and cavitation cause by the fins of the fin system as discussed earlier.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A water diffuser for a water sports board comprising:

a base, a vertical member, and a front edge;

the base having a front end and back end;

the vertical member extending from the base to a distal end, the vertical member comprising a truncated profile and a flat surface at the distal end;

the front edge extending from the front end of the base to the distal end of the vertical member;

the front edge comprising a first slope between the front end and the vertical member and a second slope along the vertical member, wherein the second slope is steeper than the first slope so as to define a concave contour;

wherein the water diffuser is configured to break-up air bubbles in a turbulent water flow caused by a fin system.

2. The water diffuser of claim 1, wherein the base further comprises a sidewall extending from a perimeter of the base to the vertical member.

3. The water diffuser of claim 2, wherein the sidewall has an overall concave contour.

4. The water diffuser of claim 1, wherein the front end of the base has a width that is smaller than a width of the back end of the base.

5. The water diffuser of claim 1, wherein the base comprises a teardrop shape.

6. The water diffuser of claim 1, wherein the base comprises a shape selected from a triangular shape, a rectangular shape, a polygonal shape, a regular elliptical shape, or an irregular elliptical shape.

7. The water diffuser of claim 1, wherein opposite the vertical member the base comprises an underside surface.

8. The water diffuser of claim 7, wherein the underside surface is coated with an adhesive.

9. The water diffuser of claim 8, wherein the adhesive has a thickness of about 0.03 inches.

10. The water diffuser of claim 1, wherein the base has a longitudinal length extending from a pointed end to a round end that ranges from about 0.7 inches to about 3.0 inches.

11. The water diffuser of claim 1, wherein the vertical member further comprises an elongated elliptical cross-section defined by a first sidewall and a second sidewall.

12. The water diffuser of claim 10, wherein the vertical member has a width from about 0.06 inches to about 0.4 inches.

13. The water diffuser of claim 1, wherein the combined height of the base and vertical member ranges from about 0.1 inches to about 2.0 inches.

14. The water diffuser of claim 1, wherein the base and vertical member each comprises a rigid material.

15. The water diffuser of claim 14, wherein the rigid material is selected from the group consisting of polymer plastic, carbon fiber, fiberglass, epoxy, metal, foam, and combinations thereof.

16. The water diffuser of claim 15, wherein the base and the vertical member comprise the same rigid material.

17. The water diffuser of claim 1, wherein the flat surface has an elliptical shape or a teardrop shape.

18. The water diffuser of claim 1, further comprising a screw hole, a lip portion, or a combination of both.

19. A water diffuser for a water sports board comprising:

a base, a vertical member, and a front edge;

the base having a front end and back end;

the vertical member extending from the base to a distal end;

the front edge extending from the front end of the base to the distal end of the vertical member;

the front edge comprising a first slope between the front end and the vertical member and a second slope along the vertical member, wherein the second slope is steeper than the first slope so as to define a concave contour, wherein the water diffuser is configured to modulate a turbulent water flow caused by a fin system.

20. The water diffuser of claim 19, wherein the vertical member comprises a truncated profile and a flat surface at the distal end.

21. A water diffuser for a water sports board comprising:

a base comprising a teardrop shape with a front end and back end, wherein the front end is narrower than the back end;

a vertical member extending from the base to a distal end, the vertical member tapering at the distal end and comprising a truncated profile and a flat surface at the distal end; and a front edge comprising a flat portion and extending from the front end of the base to the distal end of the vertical member, wherein the front edge comprises a first slope between the front end and the vertical member, and a second slope along the vertical member, wherein the second slope is steeper than the first slope so as to define a concave contour, wherein the water diffuser reduces cavitation by modulating turbulence into a smoother flow when coming into contact with a turbulent water flow caused by a fin system.

* * * * *